US007370946B2

(12) United States Patent
Sugahara

(10) Patent No.: US 7,370,946 B2
(45) Date of Patent: May 13, 2008

(54) PUMP, LIQUID TRANSPORTING APPARATUS PROVIDED WITH THE SAME, AND LIQUID MOVING APPARATUS

(75) Inventor: Hiroto Sugahara, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 351 days.

(21) Appl. No.: 11/291,535

(22) Filed: Nov. 30, 2005

(65) Prior Publication Data

US 2006/0120879 A1 Jun. 8, 2006

(30) Foreign Application Priority Data

Nov. 30, 2004 (JP) ..... 2004-346218

(51) Int. Cl.
*B41J 2/175* (2006.01)
*F04B 37/02* (2006.01)

(52) U.S. Cl. ..... 347/84; 417/48

(58) Field of Classification Search ..... 347/84, 347/85; 417/48, 50, 366
See application file for complete search history.

(56) References Cited

U.S. PATENT DOCUMENTS 4,412,785 A * 11/1983 Roman ..... 417/50
5,053,787 A * 10/1991 Terasawa et al. ..... 347/22
5,760,806 A 6/1998 Oda et al.
6,431,694 B1 * 8/2002 Ross ..... 347/85
6,637,872 B2 10/2003 Ara et al.
2002/0114715 A1 8/2002 Yoon et al.
2004/0234392 A1 11/2004 Ghoshal et al.

FOREIGN PATENT DOCUMENTS

JP 2001-310477 11/2001
JP 2005-288875 10/2005

OTHER PUBLICATIONS

U.S. Appl. No. 11/084,800, filed Mar. 21, 2005.
Jing Ni, Chuan-Jiam Zhong, Shelley J. Coldiron an Marc D. Porter, Electrochemically Actuated Mercury Pump for Fluid Flow and Delivery, Anal. Chem, 2001, vol. 73, No. 1 pp. 103-110.

* cited by examiner

*Primary Examiner*—Anh T. N. Vo
(74) *Attorney, Agent, or Firm*—Reed Smith LLP

(57) ABSTRACT

A pump includes an ink pressurizing chamber, an inlet port and an outlet port communicating with the chamber, a first valve member provided near the inlet port, a second valve member provided near the outlet port, a pressure adjustment channel communicating with the chamber, an electrode provided on a wall surface forming the channel, a driver IC which applies a voltage to the electrode, an insulating film provided on a surface of the electrode and in which when the voltage is applied to the electrode a wetting angle of ink on a surface of the insulating film is greater than that when no voltage is applied to the electrode, and a common electrode always in contact with ink in the chamber and held at a ground potential. Accordingly, a pump having a simple structure without any movable parts and with a low noise and less energy consumption can be provided.

22 Claims, 26 Drawing Sheets

PUMP, LIQUID TRANSPORTING APPARATUS PROVIDED WITH THE SAME, AND LIQUID MOVING APPARATUS

BACKGROUND OF THE INVENTION

1. Field of the Invention

The present invention relates to a pump which transports a liquid having a conductivity, and a liquid transporting apparatus which is provided with the pump, and a liquid moving apparatus which moves a liquid having a conductivity.

2. Description of the Related Art

An ink supply pump which supplies ink to an ink-jet head which discharges a conductive ink onto a paper, is available as a pump which applies pressure on a liquid having conductivity, and various types of pumps are hitherto used for this ink supply pump. For example, U.S. Pat. No. 6,637,872 B2 (FIGS. 7 and 8) corresponding to Japanese Patent Application Laid-open No. 2001-310477, describes a tube pump which applies pressure to ink in a tube by pressing two rollers fixed to a roller holder which rotates. U.S. Pat. No. 6,637,872 B2 also describes a diaphragm pump which applies pressure to the ink in a housing by transmitting a torque of a cam to a diaphragm via a compressed coil spring.

However, since the ink supply pump of U.S. Pat. No. 6,637,872 B2 includes movable parts such as the rotating roller holder and the cam, it is necessary to have these movable parts, a structure to drive these parts, and furthermore a structure to transmit a rotational energy of the movable parts. As a result, the structure of the pump becomes complicated and the number of components is increased. Moreover, a noise generated during the rotary drive of the moving parts is high. Furthermore, a substantial amount of energy is required for the rotary drive of the moving parts and it is not favorable also in view of the running cost.

SUMMARY OF THE INVENTION

An object of the present invention is to provide a pump having a simple structure without any movable parts, which generates a low noise and requires less energy consumption, and a liquid transporting apparatus provided with the pump, and a liquid moving apparatus.

According to a first aspect of the present invention, there is provided a pump which includes a liquid chamber (91, 21) having an inlet port (92, 22) through which the liquid flows into the liquid chamber and an outlet port (93, 23) through which the liquid flows out of the liquid chamber and which stores a liquid (I) having conductivity; a reverse-flow preventing mechanism (94, 95, 24, 25, 37, 38, 42) which prevents a flow of the liquid (I) flowing into the liquid chamber (91, 21) through the inlet port (92, 22) and out of the liquid chamber (91, 21) through the outlet port (93, 23) from reversing; a pressure adjustment channel (96, 26) which communicates with the liquid chamber (91, 21) and which changes a pressure of the liquid (I) in the liquid chamber (91, 21); a first electrode (97, 27) which is provided on a wall surface which defines the pressure adjustment channel (96, 26); and insulating film (98, 28) which is provided on a surface of the first electrode (97, 27) and in which, when a predetermined voltage is applied to the first electrode (97, 27), a wetting angle of the liquid (I) on a surface of the insulating film (98, 28) is decreased to be smaller than a wetting angle of the liquid (I) on the surface of the insulating film when the predetermined voltage is not applied to the first individual electrode (97, 27).

According to the first aspect of the present invention, the pump is structured such that a power source such as a first voltage applying unit applies a predetermined voltage to the first electrode to move the liquid in the liquid chamber to the pressure adjustment channel, thereby decreasing the pressure in the liquid chamber to suck the liquid into the liquid chamber through the inlet port; and the power source such as the first voltage applying unit stops to apply the predetermined voltage to move the liquid in the pressure adjustment channel to the liquid chamber, thereby increasing the pressure in the liquid chamber to discharge the liquid out of the liquid chamber through the outlet port. Moreover, in the pump of the present invention, a voltage applying unit which applies a predetermined voltage to the first electrode may be provided.

In the pump of the present invention, the pump may also be structured such that the first voltage applying unit applies the predetermined voltage to the first electrode to move the liquid in the liquid chamber to the pressure adjustment channel, thereby decreasing a pressure in the pressure chamber to suck the liquid into the liquid chamber through the inlet port; and the first voltage applying unit stops to apply the predetermined voltage to move the liquid in the pressure adjustment channel into the liquid chamber, thereby increasing the pressure in the liquid chamber to discharge the liquid out of the liquid chamber through the outlet port.

In the pump of the present invention, when the voltage is applied to the first electrode by a power source such as the first voltage applying unit, a so-called phenomenon of electrowetting occurs in which a wetting angle of the liquid on the surface of the insulating film on the surface of the first electrode is decreased. As the electrowetting occurs, due to a capillary force generated in the pressure adjustment channel, the liquid moves from the liquid chamber to the pressure adjustment channel. Therefore, the pressure inside the liquid chamber is decreased and the liquid flows into the liquid chamber through the inlet port (capillary electrowetting phenomenon which will be described later). On the other hand, when the application of the voltage to the first electrode is stopped, the wetting angle of the liquid on the surface of the insulating film on the surface of the first electrode is increased and, due to the capillary force generated in the pressure adjustment channel, the liquid moves from the pressure adjustment channel to the liquid chamber. Therefore, the pressure inside the liquid chamber is increased and the liquid flows out from the liquid chamber through the outlet port. Since the reverse-flow preventing mechanism is provided, an outflow of the liquid through the inlet port or an inflow of the liquid through the outlet port is prevented. Therefore, when the pressure in the liquid chamber is decreased, the liquid flows in only through the inlet port and when the pressure in the liquid chamber is increased, the liquid flows out only through the outlet port. Accordingly, the liquid in the liquid chamber is pressurized assuredly.

Thus, the pump of the present invention pressurizes the liquid in the liquid chamber by moving the liquid in the pressure adjustment channel by repeatedly applying the voltage to the first electrode and releasing the voltage applied to the first electrode to change the wetting angle of the liquid on the surface of the insulating film. Therefore, the structure of the pump is simple without having any movable parts and it is possible to reduce a manufacturing cost. Moreover, the noise and the power consumption during an operation of the pump are also reduced.

Moreover, in the pump of the present invention, when the predetermined voltage is applied to the first electrode, the wetting angle of the liquid on the surface of the insulating film may be less than 90°; and when the predetermined voltage is not applied to the first electrode, the wetting angle may be not less than 90°. In this case, since the wetting angle on the surface of the insulating film when the voltage is applied to the first electrode is less than 90°, the liquid can be moved assuredly from the liquid chamber to the pressure adjustment channel. Moreover, since the wetting angle on the surface of the insulating film when the voltage is not applied to the first electrode is not less than 90°, the liquid can be moved assuredly from the pressure adjustment channel to the liquid chamber.

Moreover, the pump of the present invention may include a second electrode which is held at a predetermined constant voltage and which is provided in the liquid chamber or in a channel communicating with the liquid chamber through the inlet port or the outlet port to always make contact with the liquid. Accordingly, a difference in electric potential is developed assuredly between the first electrode and the liquid in contact with the common electrode. Therefore, it is possible to decrease assuredly the wetting angle on the surface of the insulating film.

Moreover, in the pump of the present invention, a channel cross-section of the pressure adjustment channel may be circular in shape. Accordingly, the capillary force in the pressure adjustment channel can be generated more effectively and a driving force of the pump is increased.

Moreover, in the pump of the present invention, a channel cross-section of the pressure adjustment channel may be rectangular in shape. Accordingly, the pressure adjustment channel can be formed easily by a method such as etching.

In the pump of the present invention, the first electrode and the insulating film may be formed on a wall surface among wall surfaces which define the pressure adjustment channel, the wall surface corresponding to a longer side of the rectangular shaped pressure adjustment channel. Accordingly, an area (dimension) of the first electrode is increased as compared to an area of the first electrode in a case in which the first electrode and the insulating film are formed on a wall surface corresponding to a shorter side of the rectangular shaped pressure adjustment channel. Therefore, the capillary force in the pressure adjustment channel can be generated more effectively and the driving force of the pump is increased.

Moreover, in the pump of the present invention, the first electrode and the insulating film may be formed to cover the wall surface which defines the pressure adjustment channel. Accordingly, the area of the first electrode is increased. Therefore, the capillary force in the pressure adjustment channel can be generated more effectively and the driving force of the pump is increased.

In the pump of the present invention, the reverse-flow preventing mechanism may include a first valve member which is provided in the vicinity of the inlet port and which opens the inlet port only when the liquid flows in the liquid chamber through the inlet port; and a second valve member which is provided in the vicinity of the outlet port and which opens the outlet port only when the liquid flows out of the liquid chamber through the outlet port. Accordingly, the outflow of liquid from the liquid chamber through the inlet port is prevented by the first valve member and the inflow of liquid through the outlet port is prevented by the second valve member. Thus, it is possible to prevent the flow of the liquid from reversing.

Moreover, in the pump of the present invention, the reverse-flow preventing mechanism may include an inlet channel which communicates with the inlet port and which is formed such that a channel area of the inlet channel becomes smaller toward the liquid chamber, and an outlet channel which communicates with the outlet port and which is formed such that a channel area of the outlet channel becomes smaller toward a side opposite to the liquid chamber. Accordingly, a channel resistance when the liquid outflows through the inlet channel is greater than a channel resistance when the liquid flows into the liquid chamber through the inlet channel. Therefore, the liquid hardly outflows from the liquid chamber through the inlet channel. Moreover, a channel resistance when the liquid inflows through the outlet channel is greater than a channel resistance when the liquid outflows from the liquid chamber through the outlet channel. Therefore, the liquid hardly inflows into the liquid chamber through the outlet channel.

Moreover, in the pump of the present invention, the reverse-flow preventing mechanism may include a first channel connecting the inlet port and the outlet port, a second channel connecting the liquid chamber and the first channel, and the second channel may be joined to the first channel, in the vicinity of a joining portion of the second channel with the first channel, such that a direction of flow of the liquid flowing through the second channel from the liquid chamber to the first channel makes an acute angle with a direction of flow of the liquid flowing through the first channel from the inlet port to the outlet port. Accordingly, when the pressure in the liquid chamber is decreased, there is an inflow of liquid into the liquid chamber through the inlet port, the outlet port, the first channel, and the second channel. On the other hand, when the pressure in the liquid chamber is increased, the liquid flows from the liquid chamber to the first channel through the second channel. At this time, a vortex is developed at an upstream side (side of the inlet port) of the joining portion in the first channel. Therefore, the liquid from the second channel hardly flows to the side of the inlet port and the flow of the liquid is prevented from reversing.

The pump of the present invention may be an ink-supply pump which is connected to a recording head which transports an ink to a recording medium to perform recording, and which supplies the ink to the recording head. Accordingly, it is possible to supply the ink to the ink head by a pump having a simple structure without any movable parts, and which generates a low noise and requires less energy consumption.

The pump of the present invention may be an ink-circulation pump which is provided to at least one of two transporting channels connecting a recording head which transports an ink to a recording medium to perform recording and an ink-supply source, and which circulates the ink between the recording head and the ink-supply source. Accordingly, it is possible to circulate the ink by the pump having a simple structure without any movable parts, and which generates a low noise and requires less energy consumption, and to prevent any air bubble from remaining in the recording head.

According to a second aspect of the present invention, there is provided a liquid transporting apparatus (3) which includes a liquid transporting section (1) having a plurality of transporting channels (13) which transport a liquid (I) in a predetermined direction; and the pump (2) in which the discharge port (23) communicates with the plurality of transporting channels (13), and which pressurizes the liquid (I) in the predetermined direction, wherein the liquid transporting section (1) includes: a first channel electrode (14) which is formed on an inner surface of each of the transporting channels (13); a second channel electrode (15) which is formed in the vicinity of the first channel electrode (14) formed on the inner surface of each of transporting channels (13); a second voltage applying unit (16) which applies voltage to the first channel electrode (14) and the second channel electrode (15); a first insulating film (18) which is provided on a surface of the first channel electrode (14), and in which, when no voltage is applied to the first channel electrode (14), a wetting angle of the liquid on a surface of the first insulating film is greater than a wetting angle of the liquid on an area on the inner surface of each of the transporting channels, the area being other than an area in which the first channel electrode (14) and the second channel electrode (15) are formed; a second insulating film (18) which is formed on a surface of the second channel electrode (15), and in which, when no voltage is applied to the second channel electrode (15), a wetting angle of the liquid on a surface of the second insulating film is greater than a wetting angle of the liquid on the area on the inner surface of each of the transporting channels (13), the area being other than the area in which the first channel electrode (14) and the second channel electrode (15) are formed; and an opening and closing controlling mechanism (67) which causes the second voltage applying unit (16) to apply the voltage to the second channel electrode (15) so that a gas is positioned at least on the surface of the first insulating film (18), thereby closing one of the transporting channels (13), and which causes the second voltage applying unit (16) to apply the voltage to the first channel electrode (14) so that the gas is positioned at least on the surface of the second insulating film, thereby opening one of the transporting channels (13); wherein at least a part of the first electrode (27) and the second electrode (29) of the pump (2) and at least apart of the first channel electrode (14) and the second channel electrode (15) of each of the transporting channels of the liquid transporting section (1) are formed on a same plane; and wherein at least a part of the insulating film of the pump (2) and at least a part of the first insulating film (18) and the second insulating film (18) of each of the transporting channels of the liquid transporting section (1) are formed on a same plane.

According to the second aspect of the present invention, the liquid transporting apparatus transports the liquid to the liquid transporting section by pressurizing the ink in the liquid chamber by causing the pump to operate by applying the voltage to the first electrode by the first voltage applying unit and releasing the voltage applied. Furthermore, in the liquid transporting section, the ink pressurized by the pump is transported from the transporting channel to the outside by opening and closing the transporting channel by changing the wetting angle of the ink on the surface of the insulating films on the surface of the first channel electrode and the second channel electrode by applying the voltage to the first channel electrode and the second channel electrode by the second voltage applying unit, and releasing the applied voltage. In this case, because the electrodes and the insulating films of the pump and the liquid transporting section are formed on the same plane, these electrodes and the insulating films can be formed simultaneously and the process of formation is simplified.

According to a third aspect of the present invention, there is provided a liquid moving apparatus (200, 201, 300, 301) which includes: a liquid chamber (291) which stores a liquid (CI, NCI) having conductivity; a channel (296) which communicates with the liquid chamber (291); a plurality of wall surface electrodes (297*a* to 297*e*) which are provided on a wall surface which defines the channel (296); and an insulating film (298) which is provided on surfaces of the wall surface electrodes (297*a* to 297*e*) to cover the wall surface and in which, when a predetermined voltage is applied to the wall surface electrodes (297*a* to 297*e*), a wetting angle of the liquid on a surface of the insulating film (298) is decreased to be smaller than a wetting angle of the liquid on the surface of the insulating film when the predetermined voltage is not applied to the wall surface electrodes.

According to the third aspect of the present invention, by applying a predetermined voltage to the plurality of electrodes provided on a wall surface of a capillary tube, a height of a liquid level in the capillary tube due to capillarity can be adjusted based on the capillary electrowetting phenomenon found by the inventor of the present invention. Particularly, when a colored liquid having conductivity (such as dye-based ink) is used, shades of the color or the like are seen to be different, as viewed from a long axis direction of the capillary tube, according to the height of the liquid level. Moreover, when the capillary tube is viewed from a direction orthogonal to the long axis direction, the capillary tube can be identified as colored line according to the height of the liquid level in the capillary tube. Moreover, the liquid moving apparatus of the present invention may be a display apparatus.

The display apparatus of the present invention may have a plurality of individual channels arranged in a line or a plurality of individual channels arranged in a matrix form. By arranging the individual channels in a line, and by viewing from a direction orthogonal to the long axis direction of the capillary tubes, a bar graph can be displayed. Moreover, by arranging the individual channels in the matrix form, and by viewing from the long axis direction of the capillary tubes, the display apparatus can be used as an apparatus in which the shades of the color change according to the height of the liquid level in the capillary tubes.

The display apparatus of the present invention may have a second liquid, which does not mix with the conductive liquid, on a liquid level of the conductive liquid in the channel, and the second liquid may be a nonvolatile liquid. Particularly, when the second liquid is a colored liquid, and when the capillary tube is viewed from the direction orthogonal to the long axis direction of the capillary tube, it is seen as if there is a point of a different color at an end of the colored lines. Therefore, the end of the lines can be identified clearly. Moreover, when the second liquid is nonvolatile, an evaporation of the conductive liquid can be prevented.

In the liquid moving apparatus of the present invention, the plurality of wall surface electrodes may be arranged along the channel; and the liquid may be moved to one wall surface electrode or wall surface electrodes continuously arranged, among the plurality of wall surface electrodes, when the predetermined voltage is applied to the surface electrode or the wall surface electrodes continuously arranged. Accordingly, it is possible to adjust a moving amount of the liquid to a desired value.

In the present application, a term "liquid having conductivity" indicates a liquid for which the capillary electrowetting phenomenon described later occurs by applying a voltage. For example, water and dye-based aqueous inks are liquids having conductivity.

DETAILED DESCRIPTION OF THE PREFERRED EMBODIMENTS

First of all, a capillary electrowetting phenomenon (hereinafter, "CEW phenomenon") found by inventors of the present invention which is used for transporting and moving a liquid in a pump and a liquid moving apparatus of the present invention will be described below. By using the CEW phenomenon, it is possible to control freely a rise and a fall of a liquid level in a capillary tube by a so-called capillarity, and also to adjust the liquid level in the capillary tube at a desired position.

Figure 31A:
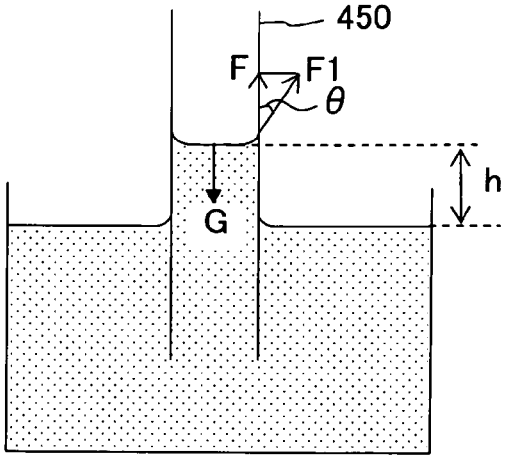
FIG. 31A is a diagram showing a capillarity when a wetting angle is less than 90°.
Figure 31B:
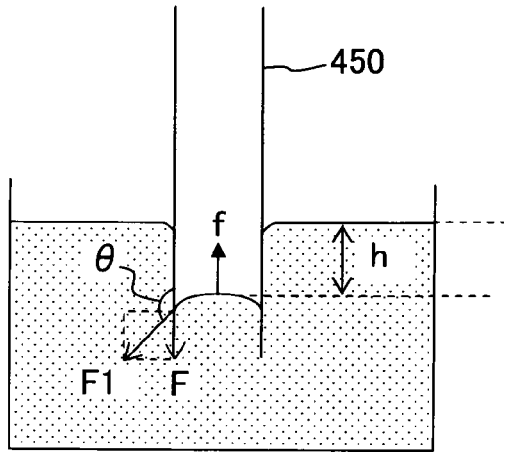
FIG. 31B is a diagram showing the capillarity when the wetting angle is greater than 90°.

As shown in FIGS. 31A and 31B, if a thin tube (capillary tube) is erected in a liquid, the liquid level inside the tube is raised up higher or falls down below the liquid level outside the tube (capillarity). According to a magnitude correlation between a cohesive force between molecules of liquid and an adhesion between the liquid and a tube wall, when the liquid wets the tube (wetting angle is smaller than 90°), the liquid level rises up, and when the liquid does not wet the tube (wetting angle is greater than 90°), the liquid level falls down.

In a case where a wetting angle θ between a tube 450 and the liquid level is smaller than 90°, a difference h in height of the liquid level inside and outside the tube 450 is determined by a proportion of a resultant force F of a surface tension F1 exerted on the liquid level of the liquid inside the tube and a gravity G exerted on the liquid in a portion which is above the liquid level outside the tube (see FIG. 31A). The difference h in the height of the liquid level inside and outside the tube when the wetting angle θ is greater than 90° is determined by the proportion of the resultant force F of the surface tension F1 exerted on the liquid level of the liquid in the tube and a buoyancy f acting on the liquid in the tube due to the drop in the liquid level inside the tube (see FIG. 31B). For example, in a case where a material of the tube is glass and the liquid is water, the rise in the liquid level inside a tube having an inner diameter of 3 mm is about 1 cm, whereas the rise in the liquid level inside a tube having an inner diameter of 0.1 mm is about 28 cm.

Thus, whether the liquid level in the tube rises up higher or falls down lower as compared to the liquid level outside the tube is determined by the material of the tube and a composition of the liquid. Furthermore, it is known that the difference h between the heights of the liquid level inside and outside the tube is an amount which is determined by the inner diameter of the tube and a density of the liquid in addition to the material of the tube and the composition of the glass. Therefore, the control of the rise and fall in the liquid level in the tube due to the capillarity could not be hitherto performed. In addition, upon setting the height of the liquid level, it was necessary to change the inner diameter of the tube accordingly.

Figure 32A:
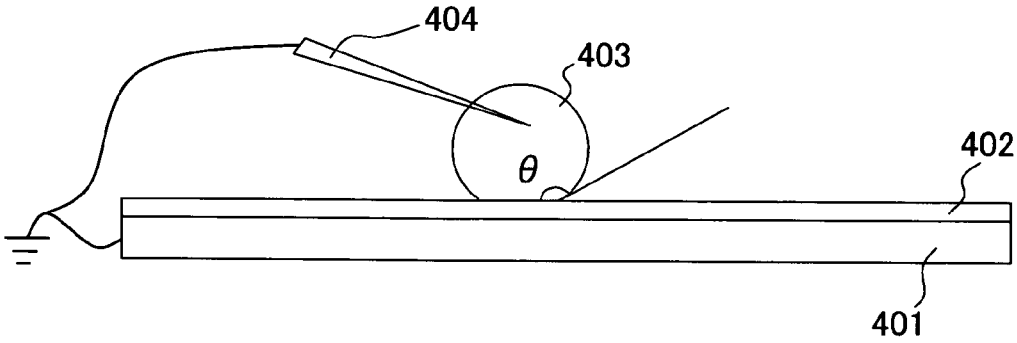
FIG. 32A is a schematic cross-sectional view when a droplet is placed on an insulating film having liquid-repellent property.
Figure 32B:
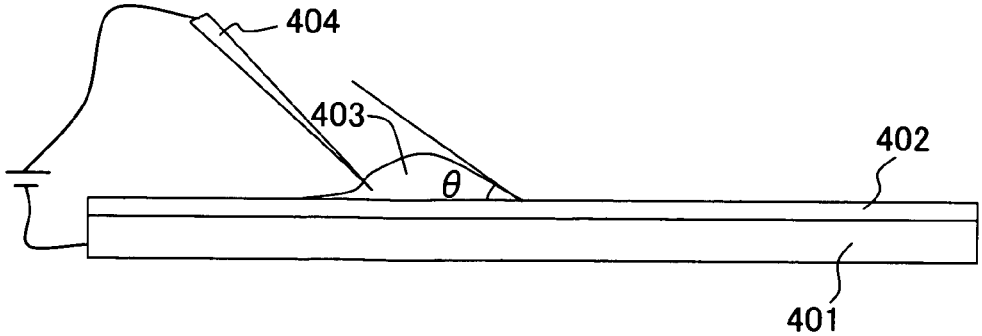
FIG. 32B is a schematic cross-sectional view showing an electrowetting phenomenon which occurs when a voltage is applied between the droplet and an electrode.

In view of these problems, the inventor of the present invention, through the diligent study and experiments to establish a technique which is capable of controlling freely the rise and fall of the liquid level in the tube and the height of the liquid level, found a new phenomenon to be called as capillary electrowetting phenomenon by combining the electrowetting phenomenon and the capillarity. In this case, according to the electrowetting phenomenon, as shown in FIGS. 32A and 32B for example, a droplet 403 of a liquid having conductivity is placed on a thin film 402 which has a liquid-repellent property and which is provided on a flat plate electrode 401. In a case in which an electrode 404 in the form of a minute wire is inserted into this droplet 403, after applying a voltage, the wetting of the thin film 402 is improved and the wetting angle θ between the thin film 402 and the droplet 403 is decreased (refer to FIG. 32B), as compared to a status shown in FIG. 32A before applying the voltage between the droplet 403 and the flat plate electrode 401.

The inventor of the present application focused his attention particularly on the following. Namely, in the electrowetting phenomenon, the wetting angle of greater than 90° can be decreased to be less than 90° by, and found that a movement of the liquid level in the capillarity can be controlled freely (CEW phenomenon) by controlling the wetting of the wall surface of the capillary tube by using the electrowetting phenomenon. In other words, by providing an electrode on the wall surface of the capillary tube, then coating the electrode and the wall surface by a thin film having a predetermined liquid-repellent property, and applying a voltage between the liquid having conductivity and the electrode, it is possible to control the movement of the liquid level according to a magnitude of the voltage and a range of applying the voltage. The inventor of the present application, based on the CEW phenomenon, completed a pump, a liquid transporting apparatus provided with the pump, and a liquid moving apparatus which can be used for various applications.

Exemplary embodiments of the present invention will be described below with reference to the accompanying drawings.

First Embodiment

A first embodiment will be described. The first embodiment is an example in which the present invention is applied to a pump which circulates ink having conductivity (conductive ink) between an ink-supply source and an ink-jet head of a printer.

Figure 1:
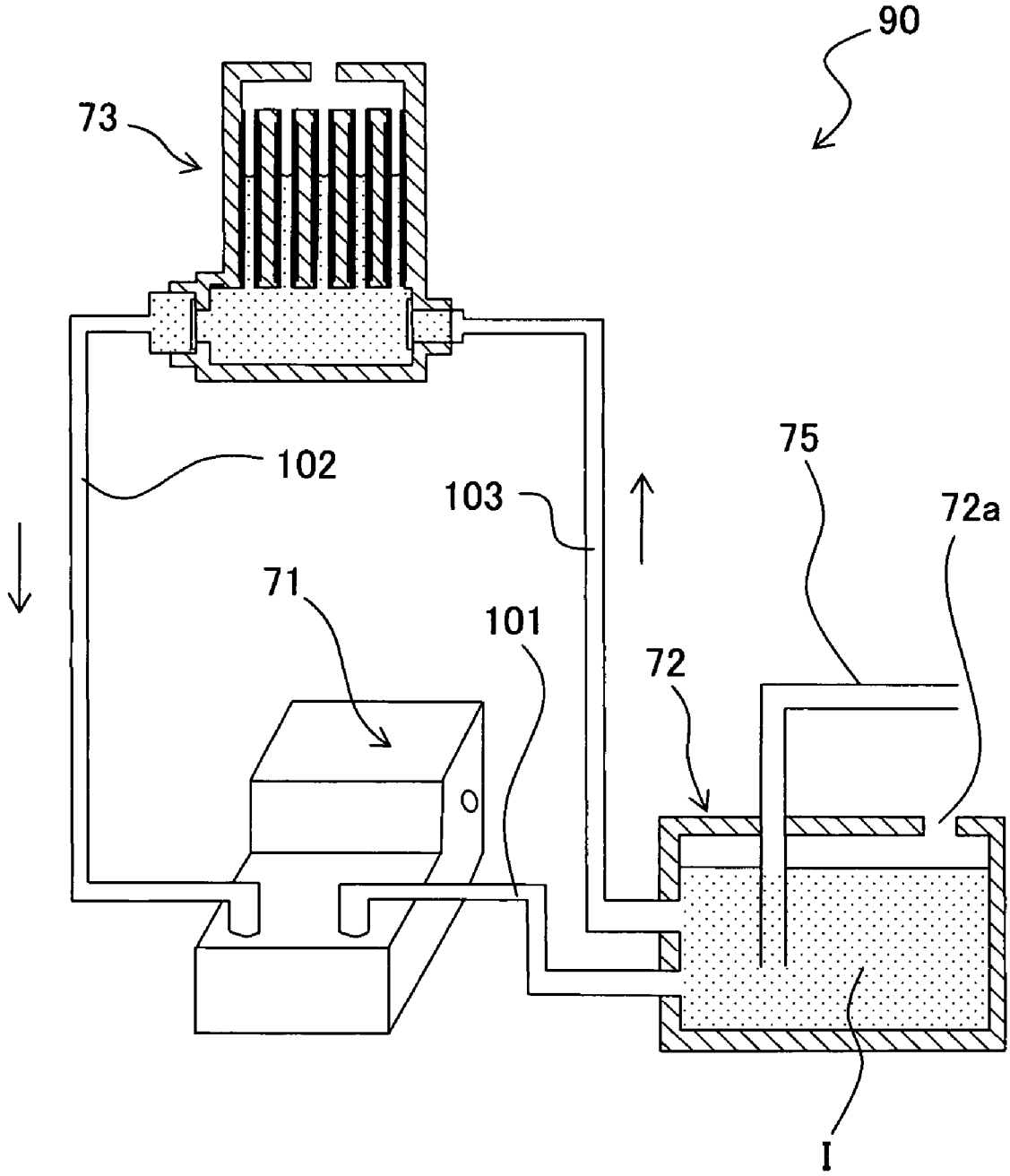
FIG. 1 is a schematic structural view of a printer according to a first embodiment.

FIG. 1 is a schematic structural diagram of a printer 90 of the first embodiment. As shown in FIG. 1, the printer 90 of the first embodiment includes an ink-jet head 71 of a serial type, an ink tank 72 (ink-supply source), a pump 73 for circulating ink between the ink-jet head 71 and the ink tank 72, and a controlling unit 110 (see FIG. 3) which controls the entire printer 90. The ink-jet head 71 and the ink tank 72 are connected by a tube 101. Moreover, the ink-jet head 71 and the pump 73 are connected by a tube 102, and furthermore, the ink tank 72 and the pump 73 are connected by a tube 103. In other words, the pump 73 is provided to one of two ink channels formed by the tubes 101, 102, and 103 and connecting the ink tank 72 and the ink-jet head 71. An ink-replenishing pipe 75 which replenishes an ink I is connected to the ink tank 72. Moreover, an air-supply section 72*a* which supplies an air is also provided to the ink tank 72.

Figure 2A:
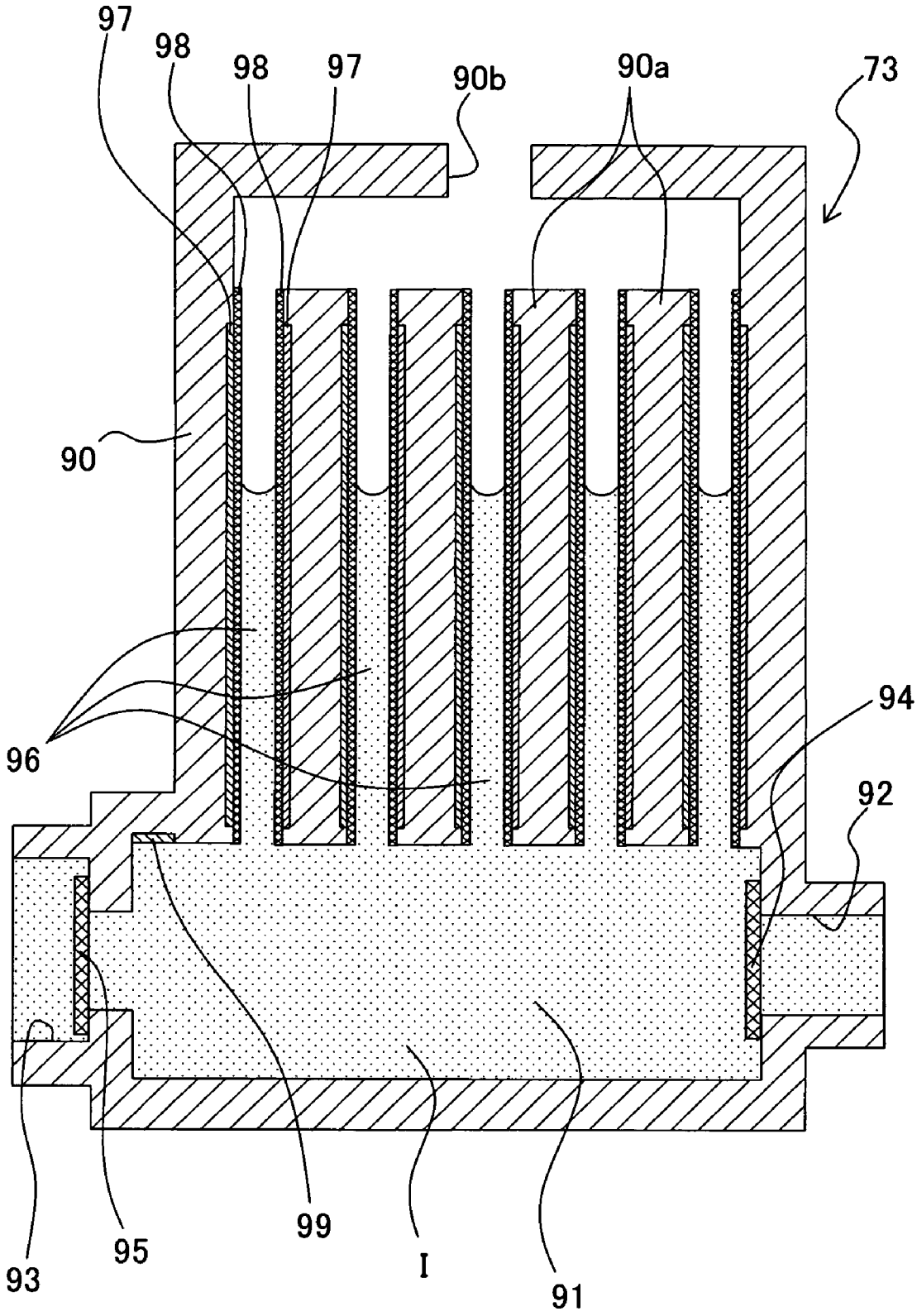
FIG. 2A is a cross-sectional view of a pump in FIG. 1.

FIG. 2A is a cross-sectional view of the pump 73. Upward and downward directions and left and right directions in FIG. 2A are defined as upward, downward, left and right directions respectively and the pump 73 will be described below. As shown in FIG. 2A, the pump 73 has a casing 90, and an ink pressurizing chamber 91 is formed inside the casing 90 in a lower side thereof. The ink pressurizing chamber 91 communicates with an inlet port 92 on a right side and an outlet port 93 on a left side. Further, the ink pressurizing chamber 91 is connected to the ink tank 72 via the inlet port 92 and the tube 103 and connected to the ink-jet head 71 via the outlet port 93 and the tube 102. Furthermore, a first valve member 94 is provided near the inlet port 92 and a second valve member 95 is provided near the outlet port 93.

Figure 2B:
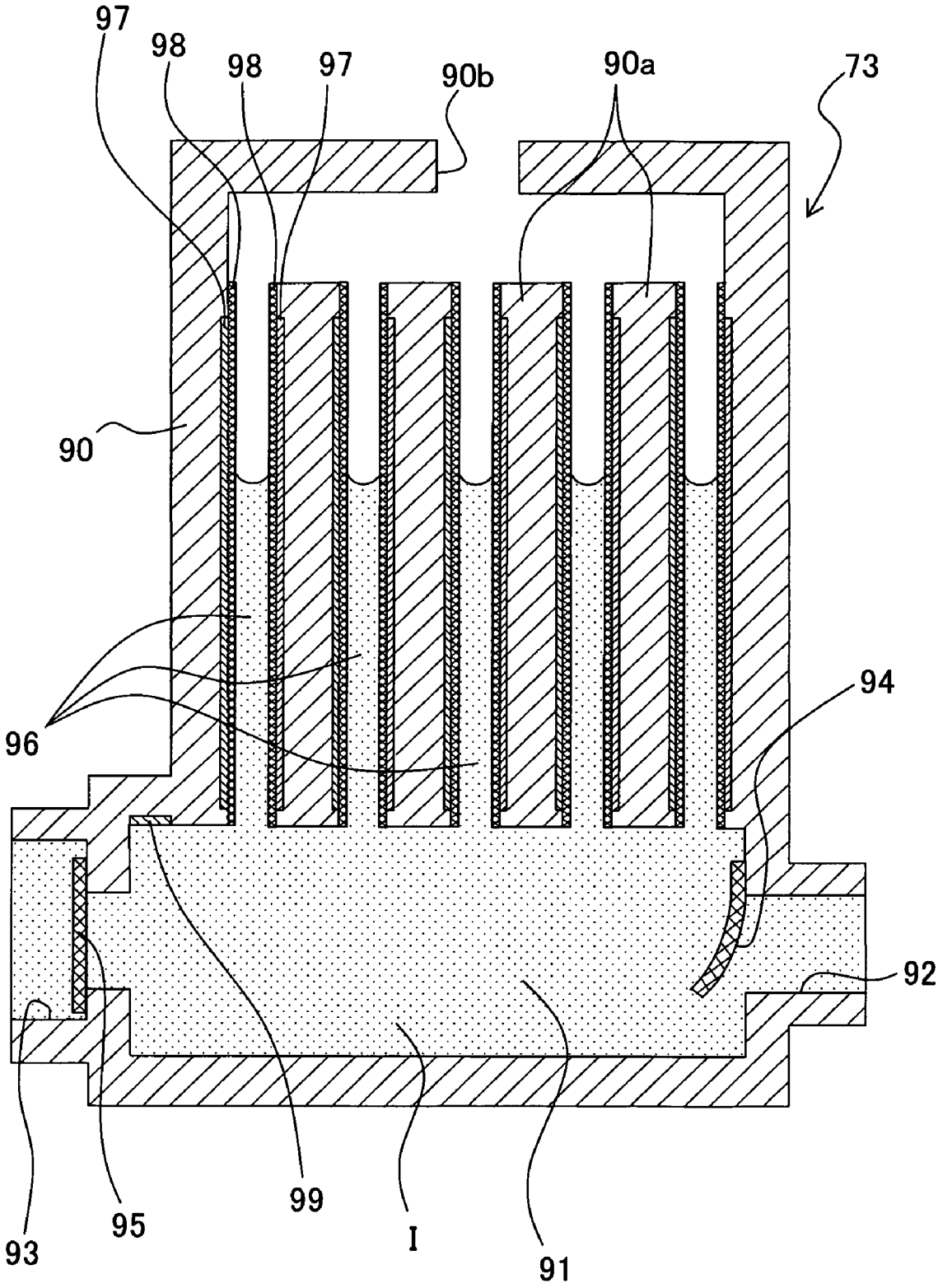
FIG. 2B is a diagram showing a start of an inflow of an ink to an ink pressurizing chamber of the pump.

This first valve member 94 is formed in the form of a thin plate and of a material having flexibility, such as rubber and synthetic resin material. One end portion of the first valve member 94 (a lower end portion in FIG. 2A) is fixed to the casing 90 and a rear surface of the other end portion of the first valve member 94 (an upper end portion in FIG. 2A) is in contact with the casing 90 on the rear surface (right surface in FIG. 2A, namely a surface not facing the pressurizing chamber 91). Therefore, when the pressure in the ink pressurizing chamber 91 is decreased, due to a pressure difference between the inside and outside of the ink pressurizing chamber 91, the first valve member 94 is bent toward left side in FIG. 2A and the end portion of the first valve member 94 is separated from the casing 90 (see FIG. 2B) and the inlet port 92 is opened. On the other hand, when the pressure in the ink pressurizing chamber 91 is increased, since the end portion of the first valve member 94 is in contact with the casing 90, the inlet port 92 is closed and the reverse flow of the ink I through the inlet port 92 to the ink tank 72 is prevented.

Figure 2C:
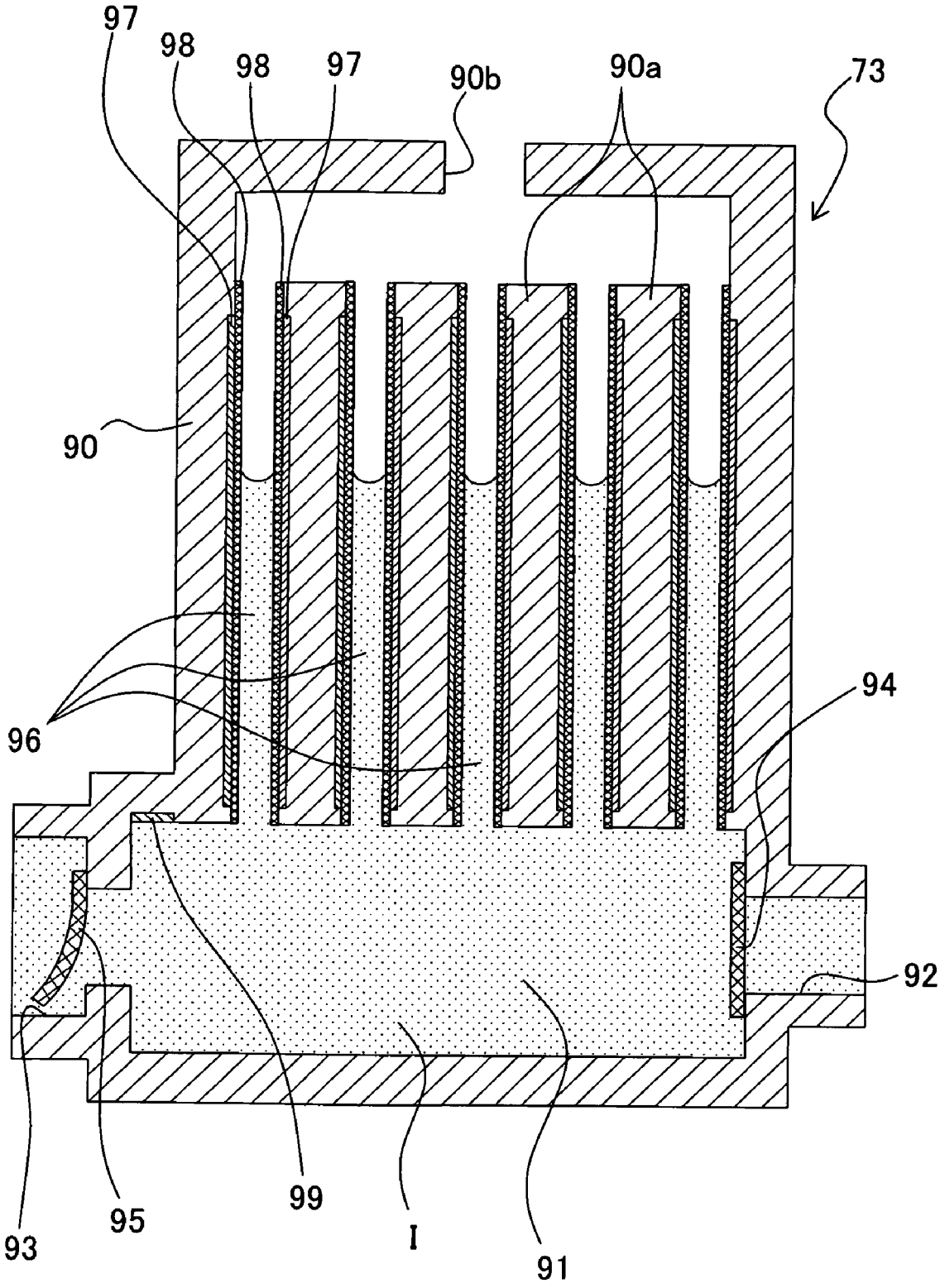
FIG. 2C is a diagram showing a start of an outflow of the ink from the ink pressurizing chamber of the pump.

On the other hand, the second valve member 95 which closes the outlet port 93 is provided near the outlet port 93. This second valve member 95, similar to the first valve member 94, is also formed in the form of a thin plate and of a material having flexibility such as rubber and synthetic resin material. One end portion of the second valve member 95 (a lower end portion in FIG. 2A) is fixed to the casing 90 and a rear surface (right surface in FIG. 2A, namely a surface facing the pressurizing chamber 91) of the other end portion (an end portion on the upper side in FIG. 2A) of the second valve member 95 is in contact with the casing 90. Therefore, when the pressure in the ink pressurizing chamber 91 is decreased, since the end portion of the second valve member 95 is still in contact with the casing 90, the outlet port 93 is closed and the reverse flow of the ink I through the outlet port 93 to the ink pressurizing chamber 91 is prevented. On the other hand, when the pressure in the ink pressurizing chamber 91 is increased, due to the pressure difference between the inside and the outside of the ink pressurizing chamber 91, the second valve member 95 is bent toward left side and the end portion of the second valve member 95 is separated from the casing 90 (see FIG. 2C) and the outlet port 93 is opened. In other words, the first valve member 94 opens the inlet port 92 only when there is an inflow of the ink I through the inlet port 92, and the second valve member 95 opens the outlet port 93 only when there is an outflow of the ink I through the outlet port 93.

Moreover, in the casing 90, four partition walls 90*a* extending in the upward and the downward direction are formed and five pressure adjustment channels 96 separated mutually by these four partition walls 90*a* are formed. The pressure adjustment channels 96 are formed such that the cross-section of the channel is rectangular in shape. The five pressure adjustment channels 96 communicate mutually at respective end portions on a side opposite to the ink pressurizing chamber 21 and furthermore, communicate with atmosphere via a communicating hole 90*b* formed in the casing 90. Moreover, an electrode 97 extending over a long axis direction of each of the pressure adjustment channels 96 is formed on a wall surface forming each of the pressure adjustment channels 96. The electrodes 97 are connected to a driver IC 111 (first voltage applying unit (means): see FIG. 3) and are structured such that a predetermined voltage is applied from the driver IC 111. Moreover, an insulating film 98 is formed on a surface of the electrode 97. When the voltage is applied to the electrode 97, the wetting angle of the ink I on a surface of the insulating film 98 becomes smaller than the wetting angle of the ink I on the surface of the insulating film 98 when the voltage is not applied to the electrode 97. Moreover, an electrode 99 which is held at a ground potential via the driver IC 111 is formed on a part of the wall surface which forms the ink pressurizing chamber 91. The ink I in the casing 90 is in contact with the electrode 99 and is held at the ground potential all the time.

Figure 3:
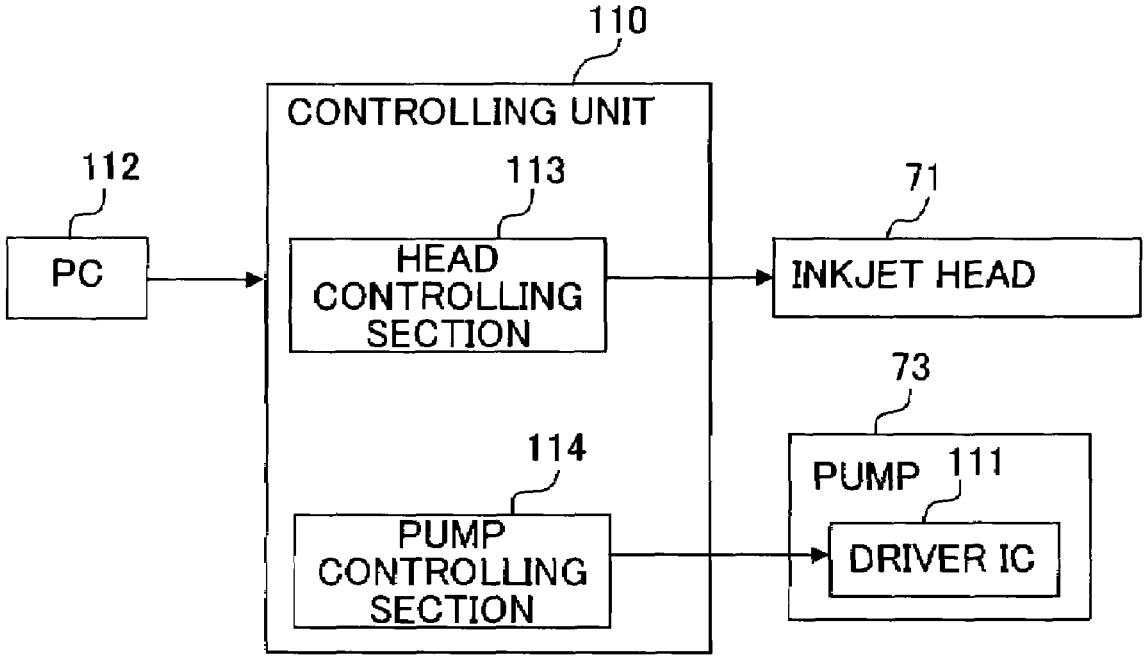
FIG. 3 is a block diagram showing an electrical structure of the printer according to the first embodiment.

Next, the controlling unit 110 of the printer 90 will be described with reference to a block diagram of FIG. 3. The controlling unit 110 includes a CPU (Central Processing Unit), a ROM (Read Only Memory) in which all programs and data for controlling all operations of the printer 90 are stored, and a RAM (Random Access Memory) which temporarily stores data processed in the CPU. Moreover, the controlling unit 110 includes a head controlling section 113 which controls a print operation by the ink-jet head 71 and a pump controlling section 114 which controls the pump 73. The controlling unit 110 controls the pump 73 by the pump controlling section 114 and circulates the ink between the ink tank 72 and the ink-jet head 71. While circulating the ink, the controlling unit 110 controls the ink-jet head 71 by the head controlling section 113 and performs the print operation on a recording paper based on a print data input from a PC 112.

Next, an operation of the pump 73 while circulating the ink between the ink tank 72 and the ink-jet head 71 will be described.

First of all, when no power is supplied to the printer 90, no voltage is applied to the first electrodes 97. Both the first valve member 94 and the second valve member 95 are closed and ink is not being circulated. From this status, when the power is supplied to the printer, a predetermined voltage is applied to the electrodes 97 from the driver IC 111 based on a command from the pump controlling section 114. As the voltage is applied to the electrodes 97, due to the capillary electrowetting phenomenon described above, the wetting angle of the ink on the surface of the insulating film 98 on the surface of the electrode 97 decreases, and due to the capillary force developed in the pressure adjustment channel 96, the ink I moves from the ink pressurizing chamber 91 to the pressure adjustment channel 96. Due to the movement of the ink I, the pressure in the ink pressurizing chamber 91 is decreased and the pressure inside the tube 102 becomes higher than the pressure in the ink pressurizing chamber 91. Therefore, the first valve member 94 is opened and there is an inflow of ink I from the tube 103 to the ink pressurizing chamber 91. When the pressure inside the ink pressurizing chamber 91 and the pressure outside of the ink pressurizing chamber 91 become equal due to the movement of the ink, the first valve member 94 is closed. Here, it is desirable that the wetting angle of the ink on the insulating film 98 on the surface of the electrode 97 when the voltage is applied to the electrode 97 is less than 90°.

Next, when the application of the voltage to the electrode 97 is stopped and the potential of the electrode 97 becomes the ground potential, the wetting angle of the ink I on the surface of the insulating film 98 on the surface of the electrode 97 increases and due to the capillary force in the pressure adjustment channel 96, the ink moves from the pressure adjustment channel 96 to the ink pressurizing chamber 91. Due to the movement of the ink, the pressure of the ink pressurizing chamber 91 becomes higher than the pressure of the tube 102. Therefore, the second valve member 95 is opened and there is an outflow of the ink I from the ink pressurizing chamber 91 through the outlet port 93. Due to the movement of the ink I, when the pressure inside the ink pressurizing chamber 91 and the pressure outside the ink pressurizing chamber 91 become the same, the second valve member 95 is closed. By the repetition of this series of operations by the pump 73, a predetermined amount of the ink I is discharged from the pump 73. Here, it is desirable that the wetting angle of the ink I on the insulating film 98 on the surface of the electrode 97 when the application of the voltage to the electrode 97 is stopped is not less than 90°.

By repeating the series of operations mentioned above, the ink I can be circulated continuously between the ink tank 72 and the ink-jet head 71 via the tubes 101, 102, and 103, and the pump 73. Accordingly, it is possible to prevent the bubbles from remaining inside the ink-jet head 71. Moreover, since the flow of the ink in the ink pressurizing chamber 91 is prevented from reversing by the first valve member 94 and the second valve member 95, the ink can be circulated assuredly.

The pump 73 of the first embodiment has a simple structure without having any movable parts, and the manufacturing cost can be suppressed. Moreover, as compared to the conventional pump, the noise and the electric power consumption of the pump during the operation is reduced. By circulating the ink I by using such an electric power saving pump 73, the air bubbles can be discharged assuredly while reducing the electric power consumption as much as possible.

Second Embodiment

A second embodiment is an example in which the present invention is applied to a printer which performs by transporting ink onto a recording paper.

Figure 4:
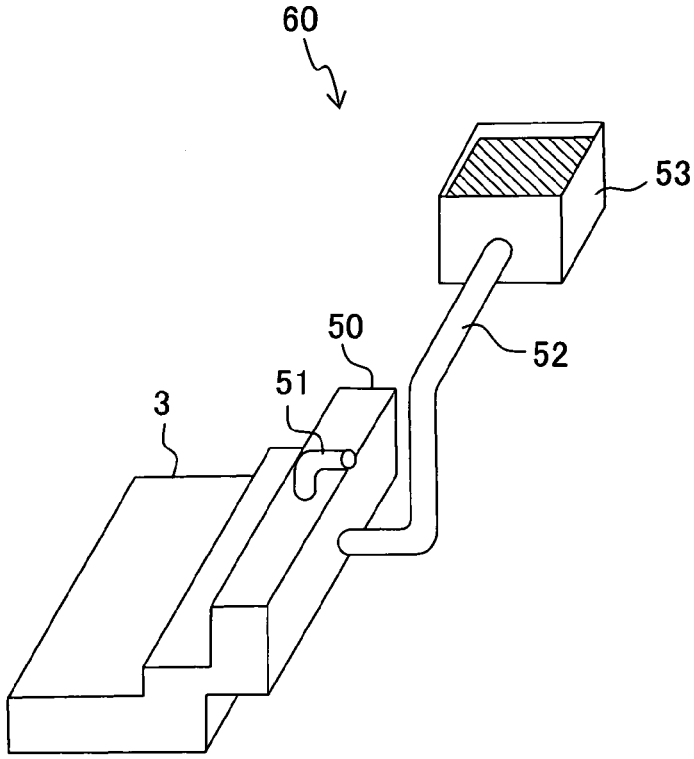
FIG. 4 is a schematic structural view of a printer according to a second embodiment of the present invention.

As shown in FIG. 4, a printer 60 of the second embodiment includes an ink tank 50 which stores the ink having conductivity (conductive ink) supplied from an ink cartridge 53, a recording unit 3 (liquid transporting apparatus) which performs recording by transporting the ink on a recording paper P (see FIG. 17 to FIG. 20), and a controlling unit 62 (see FIG. 10) which controls various operations of the printer 60 such as a recording operation by the recording unit 3. The ink cartridge 53 and the ink tank 50 are connected by an ink supply tube 52. Moreover, an air supply tube 51 is provided to the ink tank 50 for supplying air to the inside of the ink tank 50.

Figure 5:
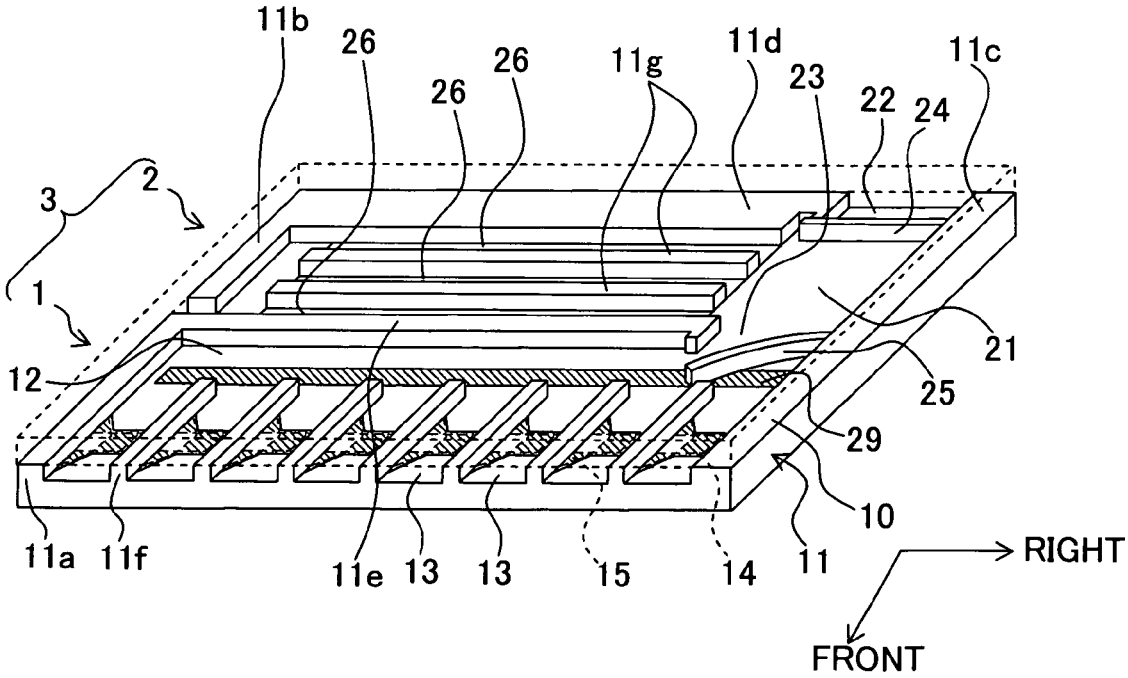
FIG. 5 is a magnified perspective view of a recording unit in FIG. 4.

Next, the recording unit 3 will be explained with reference to FIG. 5. FIG. 5 is a perspective view of the recording unit 3 in FIG. 4. Front and rear directions and left and right directions of FIG. 5 are defined as front, rear, left, and right directions respectively for the explanation. As shown in FIG. 5, the recording unit 3 includes a recording head 1 (liquid transporting section) having a plurality of ink channels 13 (transporting channels), and a pump 2 which is arranged on an rear side of the recording head 1 and which supplies the ink to the recording head 1.

The recording unit 3 includes a first channel forming member 10 and a second channel forming member 11 which have a shape of a rectangular plate and the first channel forming member 10 and the second channel forming member 11 are joined so as to face each other. The first channel forming member 10 and the second channel forming member 11 are formed of a material such as glass, polyimide, or silicon having $SiO_2$ (silicon dioxide) formed on a surface thereof, and has an insulating property at least on a surface which makes contact with the ink or on a surface on which the electrodes are formed, which will be described later.

As shown in FIG. 5, partition walls 11*a* and 11*b* extending in the front and rear direction are formed in a divided manner on a left end portion on an upper surface of the second channel forming member 11 positioned at a lower side, and a partition wall 11*c* extending from a front end to a rear end is formed on a right end portion. Furthermore, a partition wall 11*d* extending from the left end up to the vicinity of the right end is formed on a rear end portion of the second channel forming member 11. The recording head 1 and the pump 2 are formed in an area surrounded by these partition walls 11*a*, 11*b*, 11*c*, and 11*d*. Moreover, a partition wall 11*e* extending in the left and right direction is formed at a substantially central portion in the front and rear direction of the second channel forming member 11, and the recording head 1 on the front side and the pump 2 on the rear side are separated by this partition wall 11*e*. The partition walls 11*a*, 11*b*, 11*c*, 11*d*, and 11*e* are formed by a method such as etching on the upper surface of the second channel forming member 11.

Figure 6:
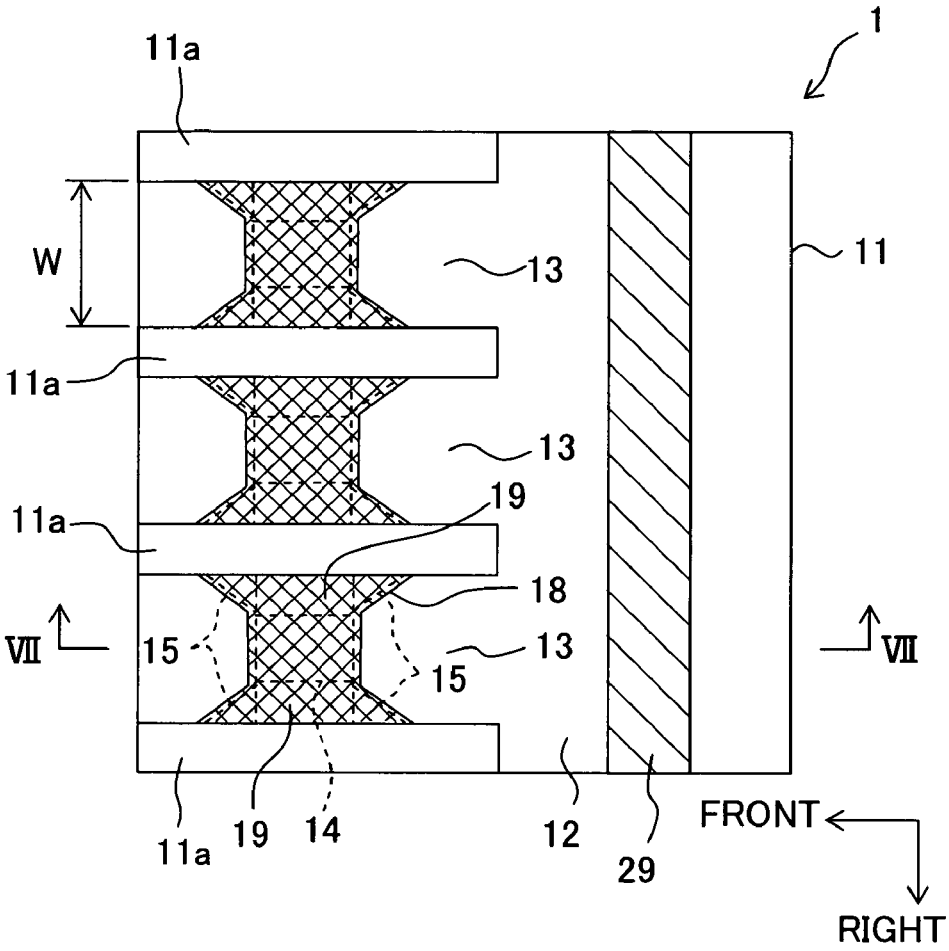
FIG. 6 is a cross-sectional view of a recording head in FIG. 5.
Figure 7:
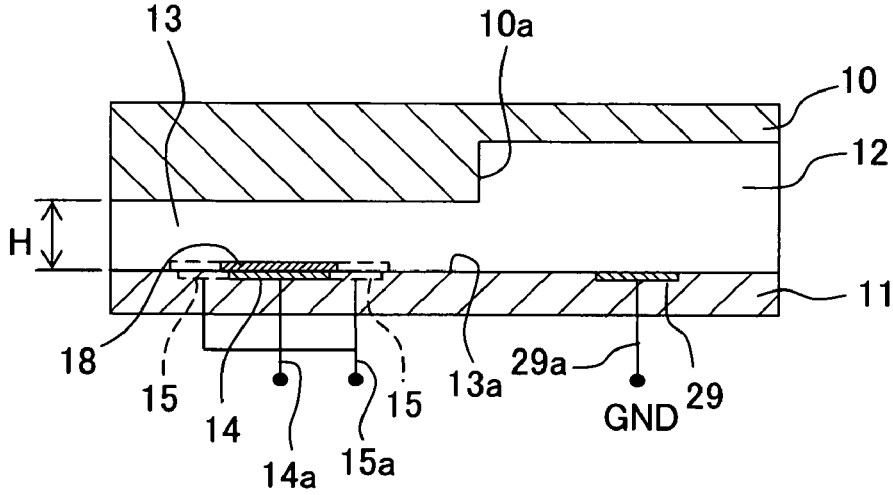
FIG. 7 is across-sectional view taken along a line VII-VII in FIG. 6.

Next, the recording head 1 will be described with reference to FIG. 5 to FIG. 7. FIG. 6 is a cross-sectional view of a part of the recording head 1 in FIG. 5. FIG. 7 is a cross-sectional view taken along a line VII-VII in FIG. 6.

A plurality of partition walls 11*f* extending in the front and rear direction is formed at equal intervals on the front end portion of the second channel forming member 11. These partition walls 11*f* are also formed by a method such as etching similarly as the partition walls 11*a*, 11*b*, 11*c*, 11*d*, and 11*e*. The ink channels 13 extending in the front and rear direction, are formed between the partition wall 11*a*, the partition wall 11*c*, and the partition walls 11*f*, such that the ink channels 13 are open on the front side. Moreover, a recessed groove 10*a* extending in the left and right direction is formed on a lower surface of the first channel forming member 10 at a portion which is located on an rear side from a portion facing the partition walls 11*f* (see FIG. 7). A manifold 12 communicating with each of the ink channels 13 is formed by the recessed groove 10*a* of the first channel forming member 10 and the second channel forming member 11. The ink I supplied from the pump 2, which will be described later, is supplied from the manifold 12 to each of the ink channels 13. The ink I is transported to the recording paper P through the ink channels 13 and a predetermined image is recorded on the recording paper P. The recording paper P is fed on the front side of FIG. 4, in a vertical direction by a paper feeding mechanism (not shown in the diagram). Each of the ink channels 13 has a rectangular cross-sectional shape, and in this embodiment, a width W of the ink channel 13 (refer to FIG. 6) is about 70 μm and a height H (refer to FIG. 7) of the ink channel is about 20 μm.

A first individual electrode 14 (first channel electrode or first electrode for opening and closing channel), which has a rectangular shape with a longer side of the rectangle in the front and rear direction as viewed in a plan view, is provided on a bottom surface 13*a* of each of the channel 13*s*, at a central portion in a width direction of each of the channel 13. On the other hand, four second individual electrodes 15 (second channel electrodes or second electrodes for opening and closing channel), which have a shape of a right angled triangle in a plan view in which a hypotenuses of the triangle crosses a direction of the low of ink I, are provided respectively in four areas adjacent to four corners of the rectangular shaped first individual electrode 14. As viewed from the direction of flow of ink I (front side or rear side), the first individual electrode 14 and the second individual electrodes 15 are arranged at positions which do not overlap with each other.

Moreover, as shown in FIG. 6, with respect to two second individual electrodes 15 positioned at an upstream side (right side in FIG. 6) of the first individual electrode 14 in the direction of flow of ink I, these two second individual electrodes 15 are formed such that a hypotenuse located on the inner side in the width direction of the second electrode 15 extends closer to the first electrode 14 toward the downstream side of the direction of flow of the ink I. In other words, these two second individual electrodes 15 are formed to have a shape in which a portion located at the downstream side of the direction of flow of the ink I is closer to the first electrode than a portion located at the upstream side. On the other hand, with respect to two second individual electrodes 15 positioned at an downstream side (left side in FIG. 6) of the first individual electrode 14 in the direction of flow of ink I, these two second individual electrodes 15 are formed such that the hypotenuse of the second electrode 15 crossing the direction of the low of ink I extends away farther from the first electrode 14 toward the downstream side of the direction of flow of the ink I. In other words, these two second individual electrodes 15 are formed to have a shape in which a portion of the second individual electrode 15 located at the downstream side of the direction of flow of the ink I is away farther from the first electrode than a portion of the second electrode 15 located at the upstream side. The first individual electrode 14 and the second individual electrodes 15 can be formed on a surface of the second channel forming member 11 by a known method such as a vapor deposition method, a sputtering method, or a printing method.

The first individual electrode 14 and the second individual electrodes 15 are electrically connected to a driver IC 16 (second voltage applying unit: see FIG. 10) via wires 14*a* and 15*a* respectively. A voltage is applied to any one of the first individual electrode 14 and the four second individual electrodes 15 by the driver IC 16 based on a signal from a head controlling section 67 (see FIG. 10). The first individual electrode 14 and the second individual electrodes 15, when no voltage is applied thereto, are grounded via the driver IC 16 and held at the ground potential.

A common electrode 29 extending in left and right directions is provided on the second channel forming member 11 at a portion defining the lower surface of the manifold 12 and this common electrode 29 is grounded all the time via a wire 29*a*. Therefore, the conductive ink I in the recording head 1 comes in contact with the common electrode 29 and the ink I is held at the ground potential all the time. The common electrode 29, similarly as the first individual electrode 14 and the second individual electrodes 15 can be formed on the surface of the second channel forming member 11 by a known method such as the vapor deposition method, the sputtering method, and the printing method.

Furthermore, an insulating film 18 is provided continuously over an area of a surface of the first individual electrode 14 and the second individual electrodes 15 and an area surrounded by these first individual electrode 14 and the second individual electrodes 15 (an area hatched by a net pattern in FIG. 6). In the insulating film 18, a portion disposed on the surface of the first individual electrode 14 and a portion disposed on the surface of the second individual electrodes 15 correspond to a first insulating film a second insulating film respectively. The insulating film 18 has a liquid-repellent property superior to or higher than a liquid-repellent property of an area of the inner surface of the ink channel 13 to which the insulating film 18 is not provided (area other than area in which the first individual electrode 14 and the second individual electrodes 15 are formed). With the superior liquid-repellent property, the ink I cannot be moved on the surface of the insulating film 18, and a bubble 20 (see FIG. 17 and FIG. 19) are positioned on the surface of the insulating film 18.

When a voltage is applied to the first individual electrode 14 or the second individual electrodes 15 by the driver IC 16, an electric potential difference is developed between the first individual electrode 14 or the second individual electrodes 15 to which the voltage is applied and the ink I held at the ground potential, and a wetting angle of the ink on a surface of a portion of the insulating film 18, positioned on the surface of the first individual electrode 14 or the second individual electrodes 15 to which the voltage is applied, is decreased, and the liquid-repellent property of the portion of the insulating film on the electrode to which the voltage is applied, is declined as compared to the liquid-repellent property when the voltage is not applied to the first individual electrode 14 or the second individual electrodes 15 (electrowetting phenomenon). Moreover, as a part of the droplet of the ink I comes in contact with an area having a superior or higher liquid-repellent property and the remaining part of the droplet of the ink I comes in contact with an area having an inferior or lower liquid-repellent property, the droplet of the ink I tend to move so that the droplet is positioned only in the area having the inferior liquid-repellent property. Accordingly, the ink I can be moved to the surface of the portion of the insulating film 18 on the electrode to which the voltage is applied. Therefore, it is possible to open and close the ink channel 13 by moving the air bubble 20 by applying the voltage to any one of the first individual electrode 14 and the second individual electrodes 15 as will be described later. The insulating film 18 can be formed by coating a fluorine-based resin on the bottom surface 13*a* of the ink channel 13 by a method such as a spin coating method. Moreover, in the first embodiment, a thickness of the insulating film 18 is about 0.1 μm.

Since the ink I is in contact with the common electrode 29 and is held at the ground potential, when the voltage is applied to any one of the first individual electrode 14 and the second individual electrodes 15, the difference in electric potential between the ink I and the first individual electrode 14 or the second individual electrodes 15 to which the voltage is applied increases, and the liquid-repellent property of the insulating film 18 on the surface of the first individual electrode 14 or the second individual electrodes 15 is assuredly declined.

Moreover, there is no electrode, to which the voltage is applied, in an area on a lower side of the insulating film 18, the area being surrounded by the areas in which the first individual electrode 14 and the second individual electrodes 15 are respectively formed. Accordingly, this area has a superior liquid-repellent property all the time. Furthermore, as shown in FIG. 6, an area below which the first individual electrode 14 is formed and high liquid-repellent areas 19 are arranged adjacent to each other in the width direction (left and right direction) of the ink channel 13, and the area below which the first individual electrode 14 is formed and the high liquid-repellent areas 19 occupy the entire area in the width direction of the bottom surface of the ink channel 13. Therefore, when no voltage is applied to the first individual electrode 14 (when the voltage is applied to the second individual electrodes 15), the air bubble 20 occupies the entire area in the width direction, and the ink channel 13 can be closed assuredly. On the other hand, areas below which the second individual electrodes 15 are formed and the high liquid-repellent areas are arranged adjacent to each other in a long axis direction (front and rear direction), and the areas beneath which the second individual electrodes 15 are formed and the high liquid-repellent areas 19 occupy only both end portions in the width direction of the bottom surface 13*a* of the ink channel 13. Therefore, when no voltage is applied to the four second individual electrodes 15 (when the voltage is applied to the first individual electrode 14), the air bubble(s) 20 is (are) positioned at both end portions in the width direction, and a central portion in the cross direction of the ink channel 13 is opened.

Figure 8:
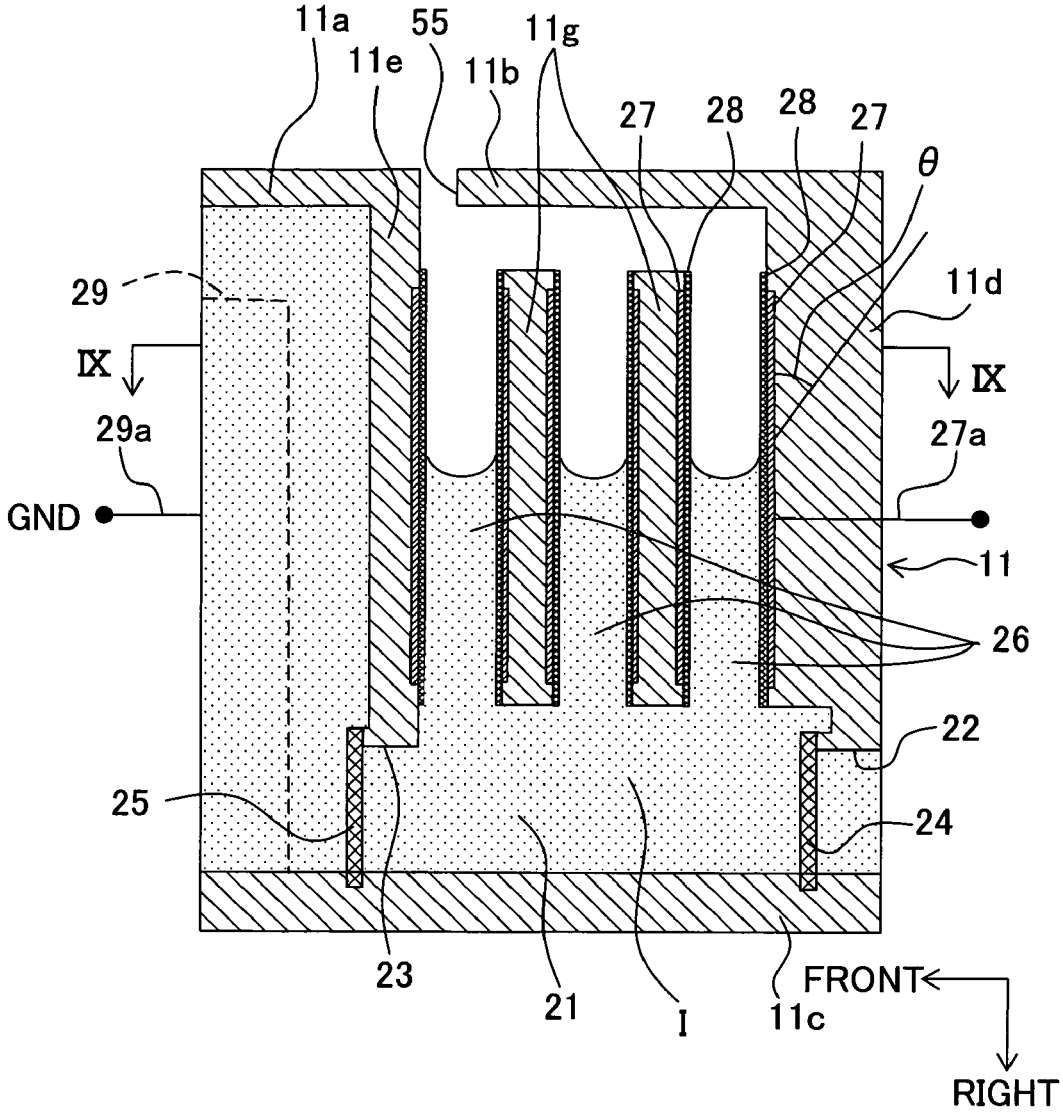
FIG. 8 is a cross-sectional view of a pump in FIG. 5.
Figure 9:
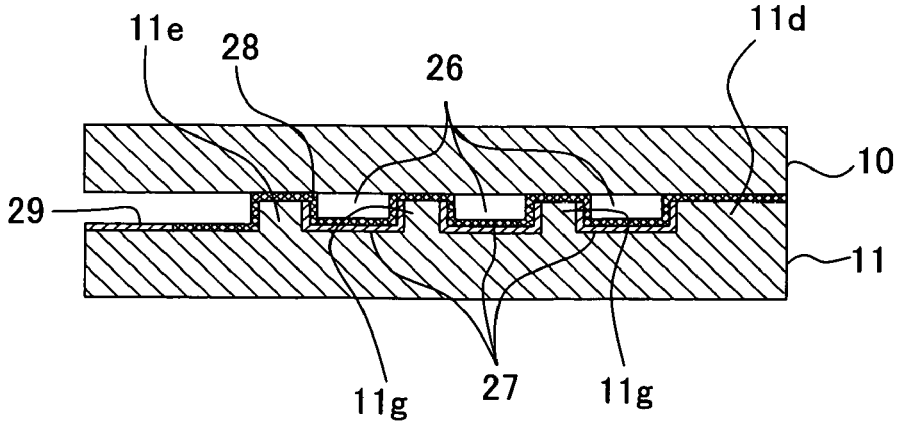
FIG. 9 is a cross-sectional view taken along a line IX-IX in FIG. 8.

Next, the pump 2 will be described with reference to FIG. 5, FIG. 8, and FIG. 9. FIG. 8 is a cross-sectional view of the pump 2 in FIG. 5 and FIG. 9 is a cross-sectional view taken along a line IX-IX in FIG. 8.

As shown in FIG. 5 and FIG. 8, two partition walls 11*g* extending to left and right are formed in a left side portion of an area on the upper surface of the second channel forming member 11 surrounded by the partition wall 11*b*, the partition wall 11*c*, the partition wall 11*d*, and the partition wall 11*e*, and three pressure adjustment channels 26 are formed between the partition walls 11*d*, 11*e*, and 11*g* extending to the left and right. Moreover, an ink pressurizing chamber 21 (liquid chamber) communicating with the three pressure adjustment channels 26 is formed on a right side of the three pressure adjustment channels 26. The three pressure adjustment channels 26 communicate mutually at respective end portions thereof on a side opposite to the ink pressurizing chamber 21, and furthermore, communicate with the atmosphere via a communicating hole 55 formed between the partition wall 11*a* and the partition wall 11*b*. As shown in FIG. 9, the pressure adjustment channels 26 are formed such that the channel cross-section is rectangular in shape. Therefore, the pressure adjustment channels 26 can be formed by only joining the first channel forming member 10 and the second channel forming member 11 after forming the partition wall 11*c*, the partition wall 11*d*, and the two partition walls 11*g* by a method such as etching, thereby making the formation process easy.

Moreover, an inlet port 22 is formed between the partition wall 11*c* and the partition wall 11*d*, and the ink pressurizing chamber 21 communicates with the ink tank 50 (see FIG. 4) via the inlet port 22. On the other hand, an outlet port 23 is formed between the partition wall 11*e* and the partition wall

11*c*, and the ink pressurizing chamber 21 communicates with the manifold 12 of the recording head 1 via the outlet port 23.

As shown in FIG. 8, a first valve member 24 which closes the inlet port 22 is provided near the inlet port 22. This first valve member 24 is formed in the form of a thin plate and of a material having flexibility such as rubber and synthetic resin material. One end portion of the first valve member 24 (a lower end portion in FIG. 8) is fixed to the partition wall 11*c* and a rear surface (right surface in FIG. 8) of the other end portion of the first valve member 24 (an upper end portion in FIG. 8) is in contact with the partition wall 11*d*. Therefore, when the pressure in the ink pressurizing chamber 21 is decreased, due to a pressure difference between the inside and outside of the ink pressurizing chamber 21, the first valve member 24 is bent toward left side in FIG. 8 and the end portion of the first valve member 24 is separated from the partition wall 11*d* (see FIG. 12 and FIG. 13), and the inlet port 22 is opened. On the other hand, when the pressure in the ink pressurizing chamber 21 is increased, since the end portion of the first valve member 24 is in contact with the partition wall 11*d*, the inlet port 22 is closed and the reverse flow of the ink I from the inlet port 22 to the ink tank 50 is prevented.

On the other hand, the second valve member 25 which closes the outlet port 23 is provided near the outlet port 23. This second valve member 25, similar to the first valve member 24, is also formed in the form of a thin plate and of a material having flexibility such as rubber and synthetic resin material. One end portion of the second valve member 25 (a lower end portion in FIG. 8) is fixed to the partition wall 11*c* and a rear surface (right surface in FIG. 8) of the other end portion (an end portion on the upper side in FIG. 8) of the second valve member 25 is in contact with the partition wall 11*e*. Therefore, when the pressure in the ink pressurizing chamber 21 is decreased, since the end portion of the second valve member 25 is still in contact with the partition wall 11*e*, the outlet port 23 is closed and the reverse flow of the ink I through the outlet port 23 to the ink pressurizing chamber 21 is prevented. On the other hand, when the pressure on the ink pressurizing chamber 21 is increased, due to the pressure difference between the inside and the outside of the ink pressurizing chamber 21, the second valve member 25 is bent toward left side of FIG. 8 and the end portion of the second valve member 25 is separated from the partition wall 11*e* (refer to FIG. 14 and FIG. 15), and the outlet port 23 is opened.

As shown in FIG. 8 and FIG. 9, an electrode 27 (first electrode) is provided on wall surfaces (bottom surface and both side surfaces) of the second channel forming member 11 which form each of the three pressure adjustment channels 26. The electrode 27 is formed over an entire area in a long axis direction of the partition wall 11*g*. The electrodes 27 can be formed by a known method such as the vapor deposition method, the sputtering method, or the printing method. The electrodes 27 are connected to a driver IC 64 (first voltage applying unit: see FIG. 10) and a voltage is applied from the driver IC 64 based on a signal from a pump controlling section 68 (see FIG. 10). Moreover, When no the voltage is applied to the electrodes 27, the electrodes are held at a ground potential via the driver IC 64.

An insulating film 28 (insulating film or insulating film for opening and closing channel) is formed on a surface of the electrode 27. This insulating film 28 can be formed by coating a fluorine-based resin on a portion of a wall surface forming the pressure adjustment channels 26, the portion being formed with the electrodes 27, by a method such as the sputtering method, the submerged or immersion coating method, and the spin coating method.

When a predetermined voltage is applied to the electrode 27 from the driver IC 64, due to the above-mentioned CEW phenomenon, a wetting angle θ of the ink I on the surface of the insulating film 28 on the surface of the electrode 27 is decreased, and due to the capillary force in the pressure adjustment channel 26, the ink I moves from the ink pressurizing chamber 21 to the pressure adjustment channel 26. Therefore, the pressure inside the ink pressurizing chamber 21 is decreased. On the other hand, when the application of the voltage to the electrodes 27 is stopped, the wetting angle θ of the ink I on the surface of the insulating film 28 is increased, and due to the capillary force in the pressure adjustment channel 26, the ink moves from the pressure adjustment channel 26 to the ink pressurizing chamber 21, and the pressure in the ink pressurizing chamber is increased. Therefore, by applying the voltage to the electrodes 27 and releasing the applied voltage, the pressure in the ink pressurizing chamber 21 can be changed. The pressurizing operation of the pump 2 will be described later in detail. Moreover, at this time, the reverse flow of the ink I, in other words, the outflow of the ink I through the inlet port 22 and the inflow of the ink I through the outlet port 23, is prevented by the first valve member 24 and the second valve member 25. Therefore, the ink I that flowed in through the inlet port 22 is pressurized inside the ink pressurizing chamber 21 and is supplied through the outlet port 23 to the manifold 12 on the front side. In this case, it is desirable that the wetting angle of the ink I on the surface of the insulating film 28 on the surface of the electrode 27 when the voltage is applied to the electrode 27 is less than 90°. Moreover, it is desirable that the wetting angle of the ink I on the surface of the insulating film 28 on the surface of the electrode 27 when the application of the voltage to the electrode 27 is stopped is not less than 90°.

Moreover, the ink I is in contact with the common electrode 29 (second electrode) formed inside the manifold 12 communicating with the ink pressurizing chamber 21 via the outlet port 23 and the ink I is kept at the ground potential all the time. Therefore, when the voltage is applied to the electrodes 27, a status is maintained in which the electric potential difference between the electrodes 27 and the ink I is high. Accordingly, when the voltage is applied to the electrode 27, the wetting angle I of the ink on the insulating film 28 on the surface thereof is decreased assuredly. Furthermore, the common electrode 29 serves as an electrode for holding the ink I in the recording head 1 at the ground potential and also as an electrode for holding the ink I in the pump 2 at the ground potential. Therefore, as compared to a case where the electrodes are formed separately for the recording head 1 and the pump 2, the manufacturing cost is reduced. The common electrode 29 is not necessarily required to be formed inside the manifold 12, and may be formed in a channel on an upstream side (side of the ink tank 50) which communicates with the ink pressurizing chamber 21 through the inlet port 22, or may be formed inside the ink pressurizing chamber 21.

All the partition walls 11*a* to 11*g* of the second channel forming member 11 can be formed by etching. Therefore it is possible to form, at a time, the channels such as the ink channels 13 and the manifold 12 of the recording head 1 and the pressure adjustment channels 26 and the ink pressurizing chamber 21 of the pump 2.

Moreover, the first individual electrodes 14, the second individual electrodes 15 and the common electrode 29 of the recording head 1, and a part of the electrodes 27 of the pump 2 are all formed on a same plane (upper surface of the second channel forming member 11). Therefore, it is possible to simplify the manufacturing process by forming these electrodes at the same time by a method such as screen printing. Furthermore, the insulating film 18 of the recording head 1 and a part of the insulating film 28 of the pump 2 are also formed on a same plane. Therefore, the manufacturing process can be further simplified by forming these insulating films at the same time.

Figure 10:
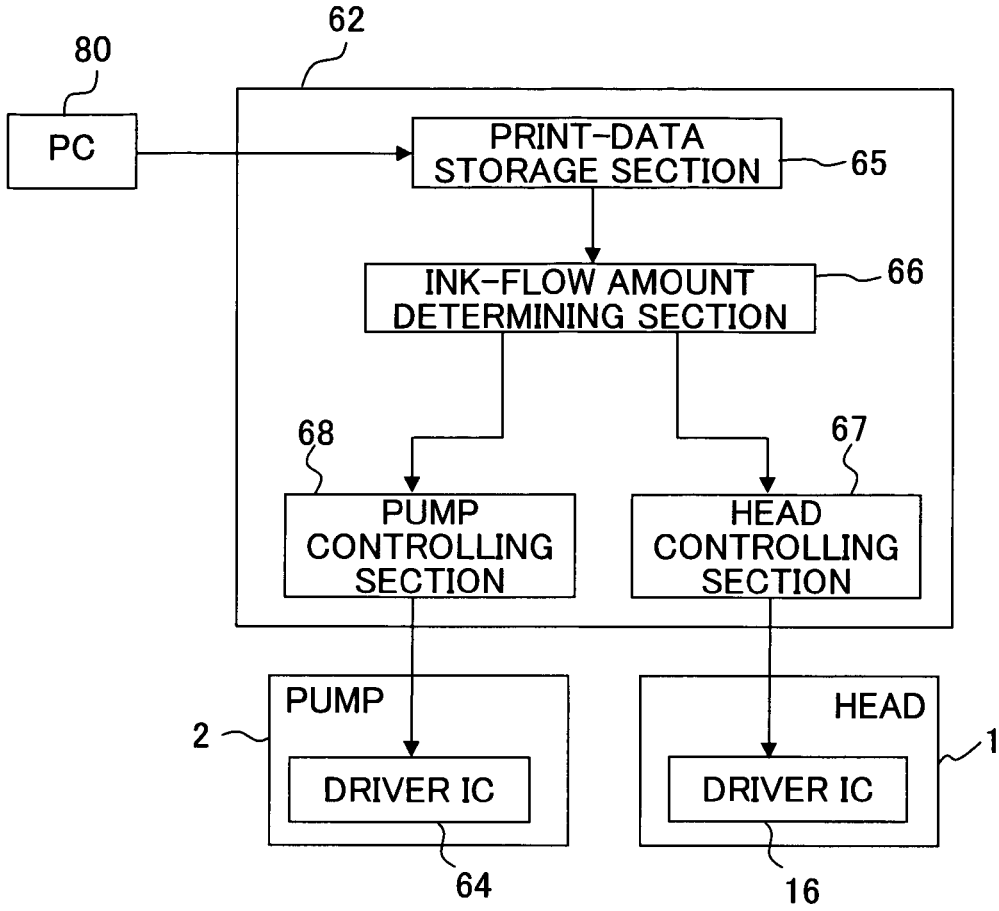
FIG. 10 is block diagram of an electrical structure of the printer according to the second embodiment.

Next, an electrical structure of the printer 60 according to the first embodiment will be described by using a block diagram in FIG. 10. A controlling unit 62 includes a CPU, a ROM in which all programs and data for controlling all operations of the printer 60 are stored, and a RAM which temporarily stores data processed in the CPU. The controlling unit 62 controls various operations of the printer 60 such as recording on a recording paper P by the recording unit 3.

Moreover, the controlling unit 62 includes a print-data storage section 65 which stores print data inputted from a personal computer (PC) 80, an ink-flow amount determining section 66 which determines an amount of ink to be transported from the ink tank 50 to the recording head 1 based on the print data stored in the print-data storage section 65, a pump controlling section 68 which controls the pump 2 which supplies the ink I to the recording head 1, and a head controlling section 67 (opening and closing controlling mechanism (means)) which controls the recording head 1 which transports the ink I onto the recording paper P (see FIG. 17 to FIG. 20). When print instructions and the print data are input to the controlling unit 62 from the PC 80, the print data is stored in the print-data storage section 65 and an ink flow amount F to be supplied to the recording head 1 is determined by the ink-flow amount determining section 66 based on the stored print data. The application of voltage to the electrode 27 (see FIG. 8) by the driver IC 64 (second voltage applying unit (means)) is controlled by the pump controlling section 68 and the ink I of the flow amount of ink F is supplied to the recording head 1. Moreover, the application of voltage to the first individual electrode 14 and the second individual electrodes 15 (refer to FIG. 6) by the driver IC 16 (first voltage applying unit (means)) is controlled by the head controlling section 67 and the ink channel 13 is opened and closed. Thus, the ink I of the ink flow amount F is transported onto the recording paper P and a predetermined image is recorded on the recording paper P. The print-data storage section 65 includes a RAM which temporarily stores the data, and each of the ink-flow amount determining section 66, the pump controlling section 68, and the head controlling section 67 is constructed of a CPU, a ROM, and a RAM and the like.

Figure 11:
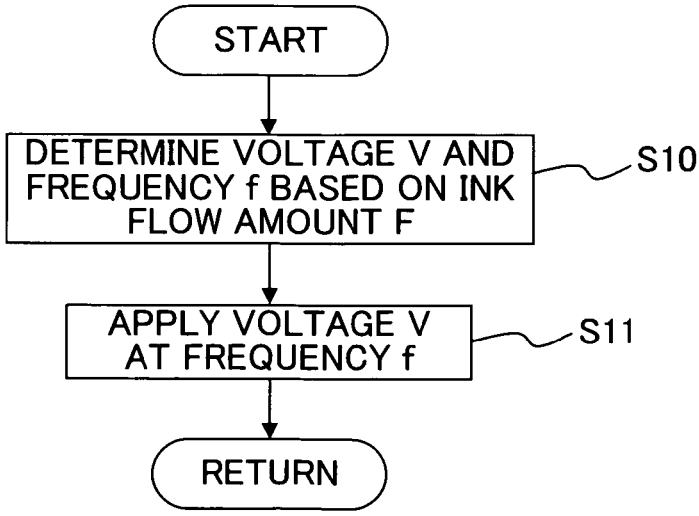
FIG. 11 is a flow chart of an ink supply process.

Next, an ink supply process executed by the pump controlling section 68 will be described with reference to a flow chart in FIG. 11, and FIG. 8, and FIG. 12 to FIG. 15. This ink supply process is executed when an image is recorded on the recording paper P by the recording unit 3 based on the print data inputted from the PC 80. In FIG. 11, Si (where i=10, 11) denotes each of the steps. Moreover, "+" at a contact section 27*a* of the electrode 27 in FIG. 12 to FIG. 15 indicates that the voltage is applied to the electrode 27, and "GND" indicates that the voltage is not applied to the electrode 27 (the electrode 27 is at the ground potential).

As shown in FIG. 8, when the ink I is not supplied to the recording head 1 from the ink tank 50 by the pump 2, the voltage is not applied to the electrode 27, the ink I is at stand still in the pressure adjustment channel 26, and both the first valve member 24 and the second valve member 25 are closed.

From the standstill status of the ink I, when the print instruction is input to the controlling unit 62 from the PC 80, the pump controlling section 68, based on the amount of ink flow amount F determined in the ink-flow amount determining section 66 and conditions such as number, height, and area of channel in the pressure adjustment channels 26, determines a drive pulse signal of a predetermined frequency f and a predetermined voltage V (step S10), and the determined drive pulse signal is applied to the electrode 27 by the driver IC 64 (step S11).

Figure 12:
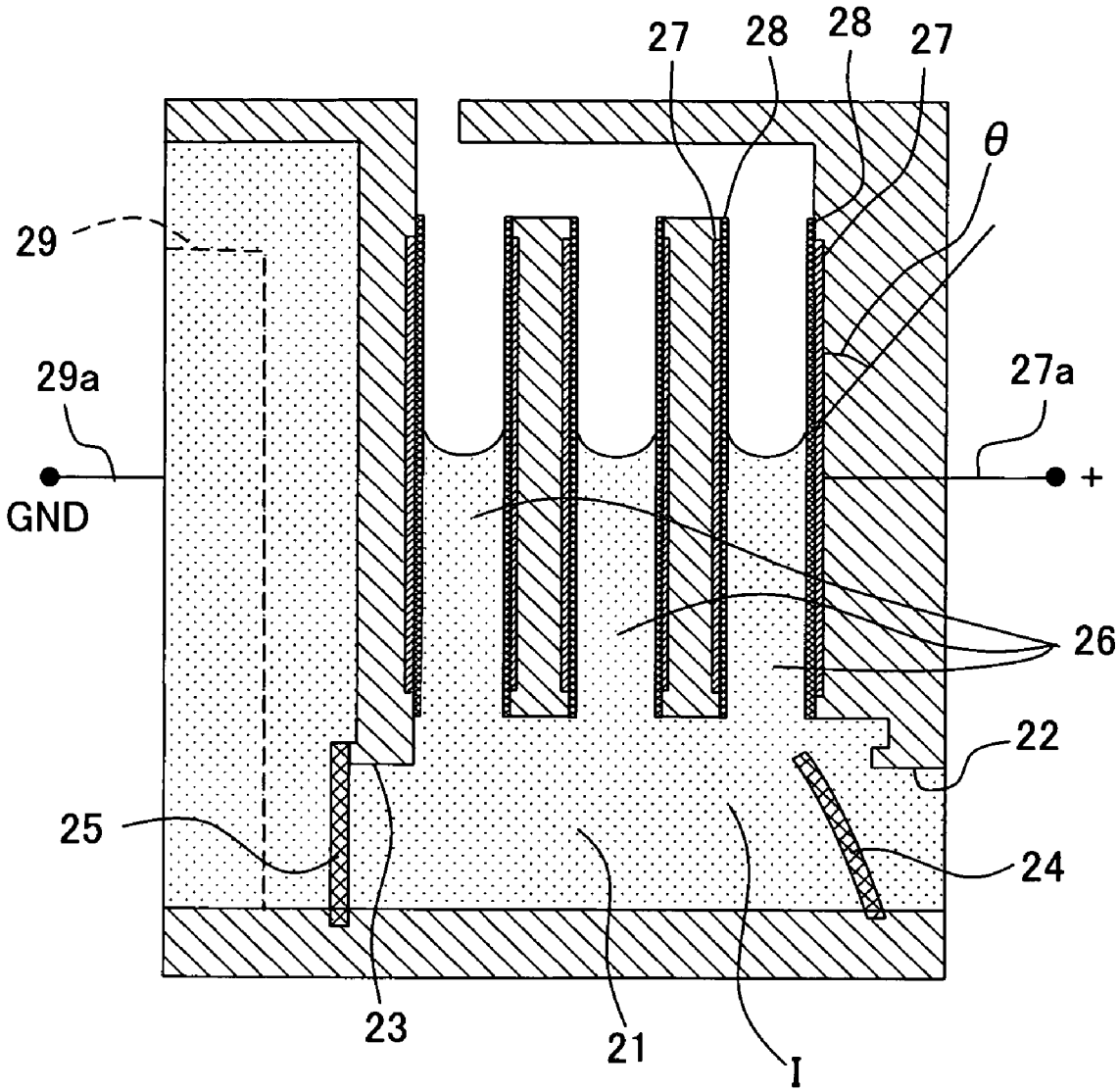
FIG. 12 is a diagram showing a start of the inflow of ink into the ink pressurizing chamber of the pump.
Figure 13:
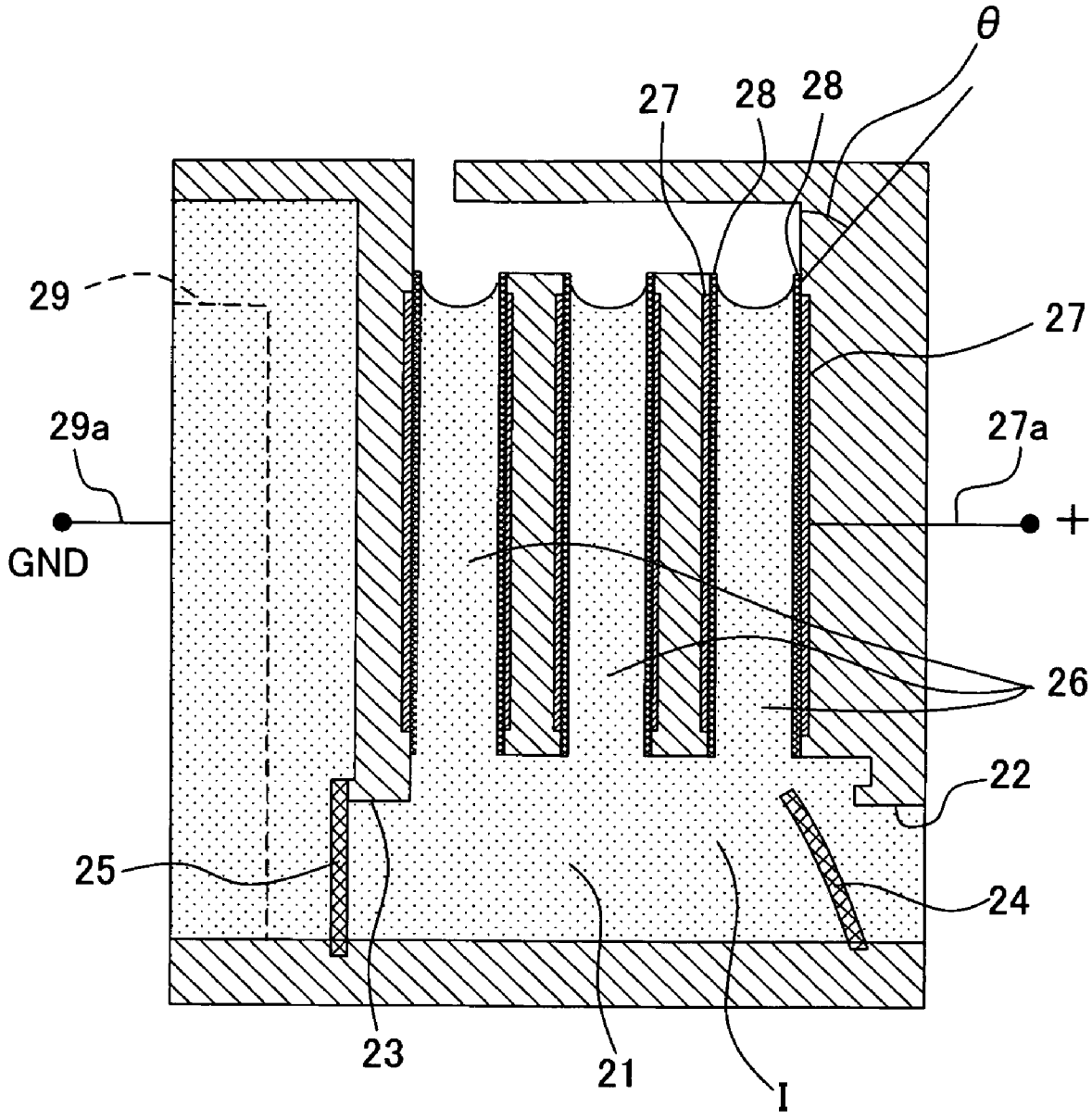
FIG. 13 is a diagram showing an end of the inflow of ink of the pump.

When the voltage is applied to the electrode 27, as shown in FIG. 12, due to the CEW phenomenon described above, a wetting angle θ of the ink I on the surface of the insulating film 28 is reduced, and due to the capillary force developed inside the pressure adjustment channel 26, the ink I moves from the ink pressurizing chamber 21 to the pressure adjustment channel 26. Therefore, the pressure inside the ink pressurizing chamber 21 is decreased. At this time, it is desirable that the wetting angle θ of the ink I on the surface of the insulating film 28 becomes less than 90°. Accordingly, since a pressure at the upstream of the ink pressurizing chamber 21 becomes higher than a pressure inside the ink pressurizing chamber 21, the first valve member 24 is opened and as shown in FIG. 13, the ink I flows into to the ink pressurizing chamber 21 from the ink tank 50. At this time, the second valve member 25 is closed and the ink does not flow into the inside of the ink pressurizing chamber 21 through the outlet port 23. When the pressure in the ink pressurizing chamber 21 and the ink tank 50 become equal due to the inflow of the ink I to the ink pressurizing chamber 21, the inflow of the ink to the ink pressurizing chamber 21 from the ink tank 50 is stopped, and the first valve member 24 is closed.

Figure 14:
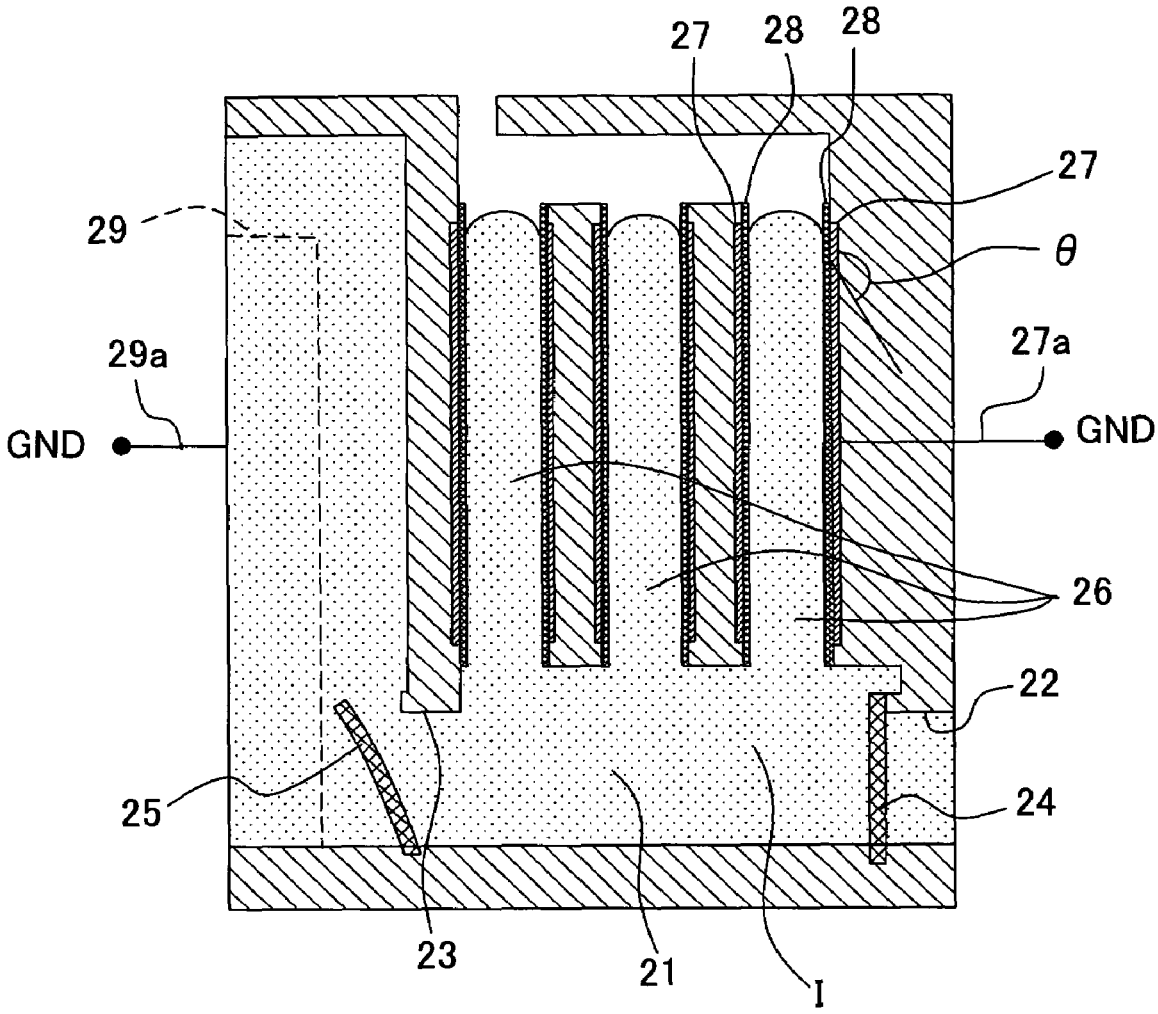
FIG. 14 is a diagram showing a start of the outflow of ink from the ink pressurizing chamber of the pump.
Figure 15:
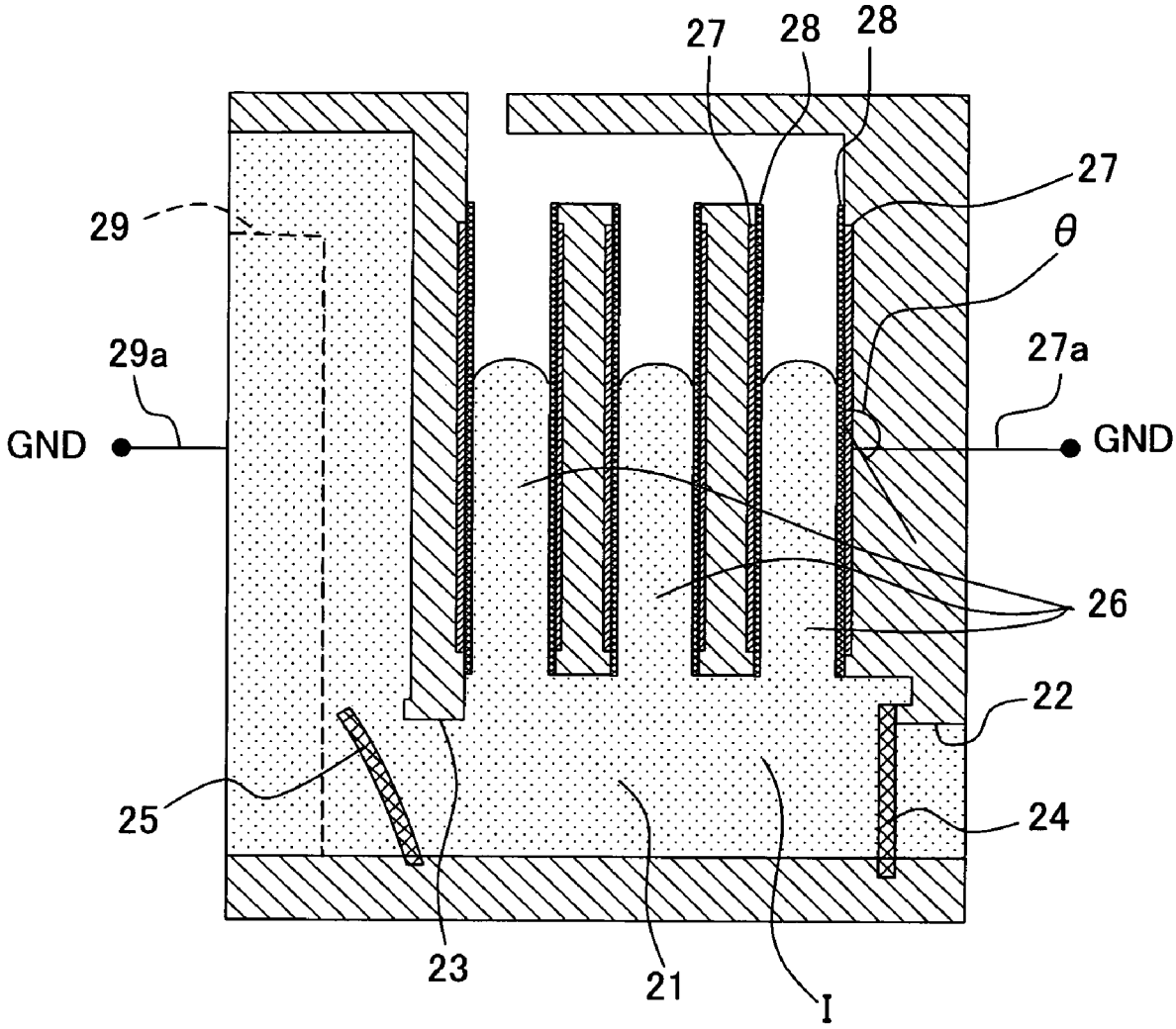
FIG. 15 is a diagram showing an end of the outflow of ink of the pump.
Figure 16:
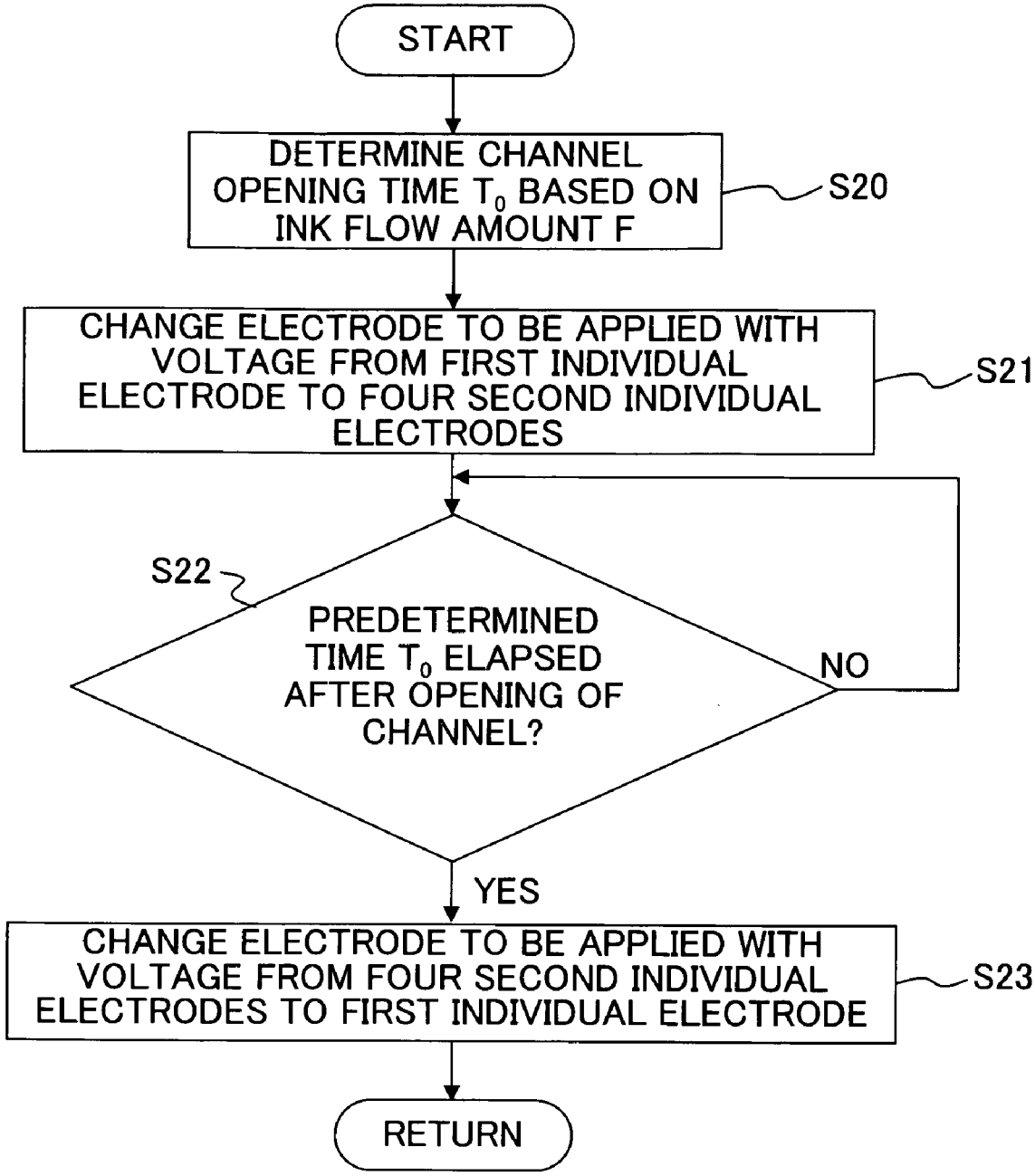
FIG. 16 is a flow chart of a channel opening and closing process.

Next, when the application of the voltage to the electrode 27 by the driver IC 64 is stopped (the electrode 27 is held at the ground potential), as shown in FIG. 14, the wetting angle θ of the ink I on the surface of the insulating film 28 increases due to the CEW phenomenon, and the ink I moves from the pressure adjustment channel 26 to the ink pressurizing chamber 21 due to the capillary force of the pressure adjustment channel 26, and the pressure inside the ink pressurizing chamber 21 is increased. At this time, it is desirable that the wetting angle of the ink I on the surface of the insulating film 28 is not less than 90°. Accordingly, the pressure inside the ink pressurizing chamber 21 becomes higher than the pressure in the manifold 12, and the second valve member 25 is opened. As shown in FIG. 15, there is an outflow of the ink I from the ink pressurizing chamber 21 to the recording head 1. At this time, the first valve member 24 is closed and there is no outflow of the ink I through the inlet port 22 to the outside of the ink pressurizing chamber 21. When there is an outflow of the ink I from the ink pressurizing chamber 21, and the pressure of the ink pressurizing chamber 21 and the recording head 1 becomes equal, the outflow of the ink I to the recording head 1 from the ink pressurizing chamber 21 is stopped and the second valve member 25 is closed. Since a voltage V with the frequency f is applied periodically to the electrode 27, the pump 2 repeats the above-mentioned operation and a predetermined flow amount F of the ink I is supplied to the recording head 1. Moreover, since the reverse flow of the ink inside the ink pressurizing chamber 21 is prevented by the first valve member 24 and the second valve member 25, the ink I can be supplied assuredly to the recording head 1.

A more specific example of the pump 2 will be described below. When a dimension of channel cross-section of the pressure adjustment channels 26 is 300 μm×100 μm, a length of the pressure adjustment channels 26 is 26, and the number of the pressure adjustment channels 26 is 20; a pulse signal having a voltage V of 30 volt and a frequency f of 1 Hz is applied to the electrodes 27; and a wetting angle θ of the ink I on the surface of the insulating film 28 when the voltage V is applied to the electrode 27 is 50° and a wetting angle θ of the ink I on the surface of the insulating film 28 when the electrode 27 is at the ground potential is 100°, it is possible to supply 0.007 cc/sec (0.42 cc/min) of the ink I.

Next, a process of opening and closing the channel by the head controlling section 67 will be described with reference to a flow chart in FIG. 16, and FIG. 17 to FIG. 19. This process of opening and closing the channel is executed in a case in which the ink I is transported onto the recording paper P via the ink channel 13, based on the print data inputted from the PC 80.

Figure 17:
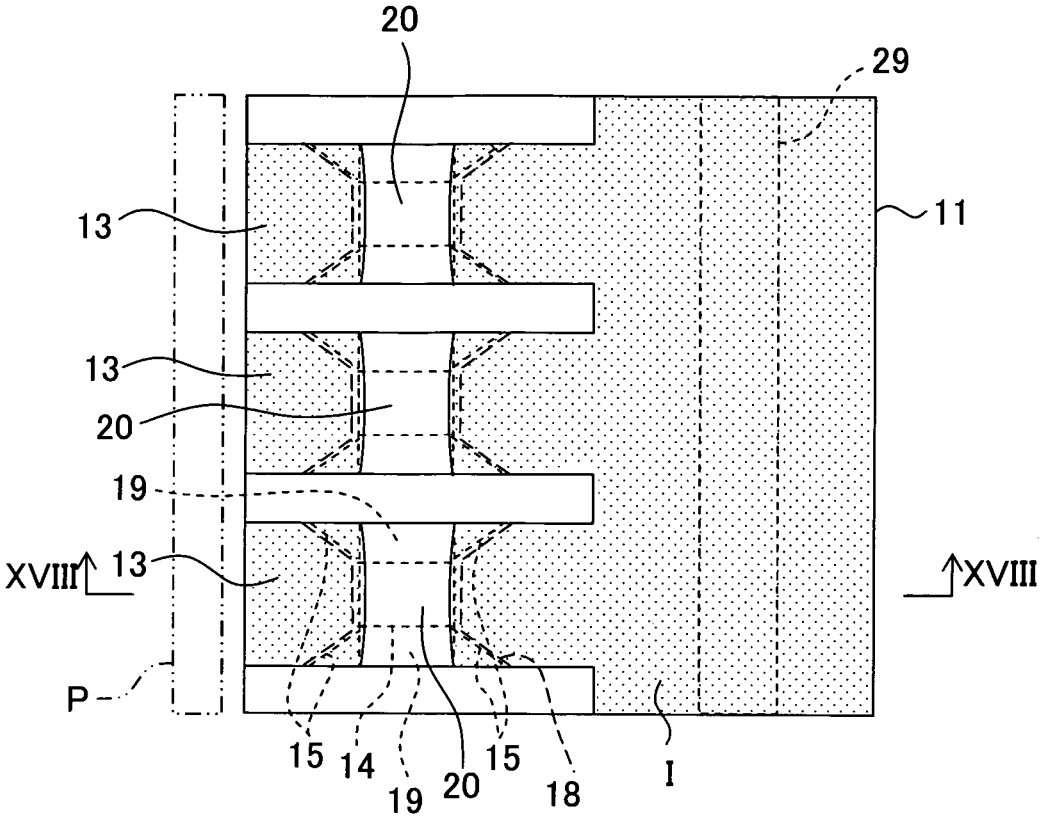
FIG. 17 is a diagram showing a status in which the ink channels of the recording head are closed.
Figure 18:
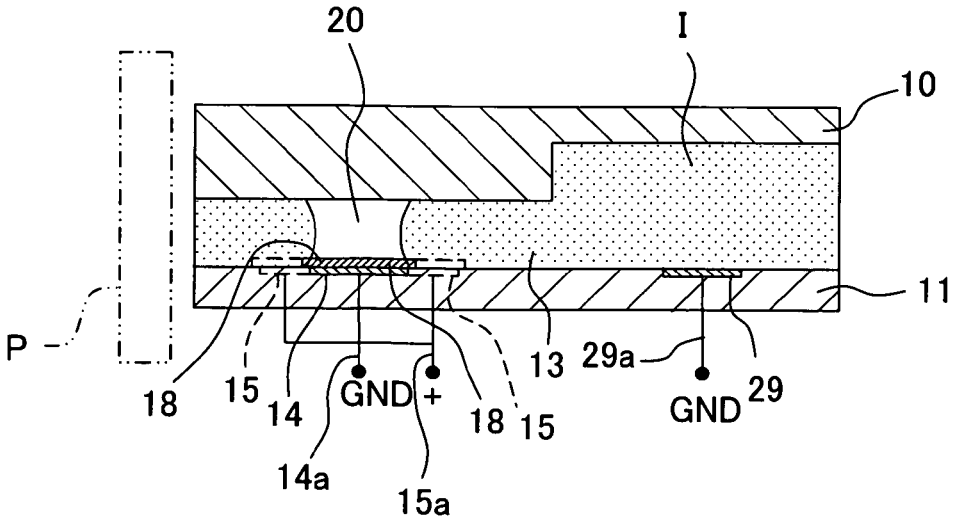
FIG. 18 is a cross-sectional view taken along a line XVIII-XVIII in FIG. 17.

As shown in FIG. 17 and FIG. 18, when the ink I is not transported by the ink channels 13, the voltage is applied only to the four second individual electrodes 15 of each of the ink channels 13, and the first individual electrode 14 is held at the ground potential. In this situation, since the wetting angle of the ink I on the insulating film 18 on the surface of the second individual electrodes 15 to which the voltage is applied is small, the ink I moves to the surface of the insulating film 18. However, on the insulating film 18 on the surface of the first individual electrode 14 to which no voltage is applied, the wetting angle of the ink I is great and the liquid-repellent property is high. Accordingly, the ink I cannot move to the surface of the insulating film 18 on the surface of the first individual electrode 14. Moreover, since the high liquid-repellent areas 19, surrounded by the area in which the first individual electrode 14 and the second individual electrodes 15 are formed, has a high liquid-repellent property all the time irrespective of the application of voltage to the first individual electrode 14 and the second individual electrodes 15, the ink I cannot move to the high liquid-repellent areas 19. Therefore, the bubble 20 is positioned over the insulating film 18 on the surface of the first individual electrode 14 and the insulating film 18 on two of the high liquid-repellent areas 19 adjacent to the insulating film on the first individual electrodes on both sides in the width direction, and thus the ink channel 13 is closed by this bubble 20.

Figure 19:
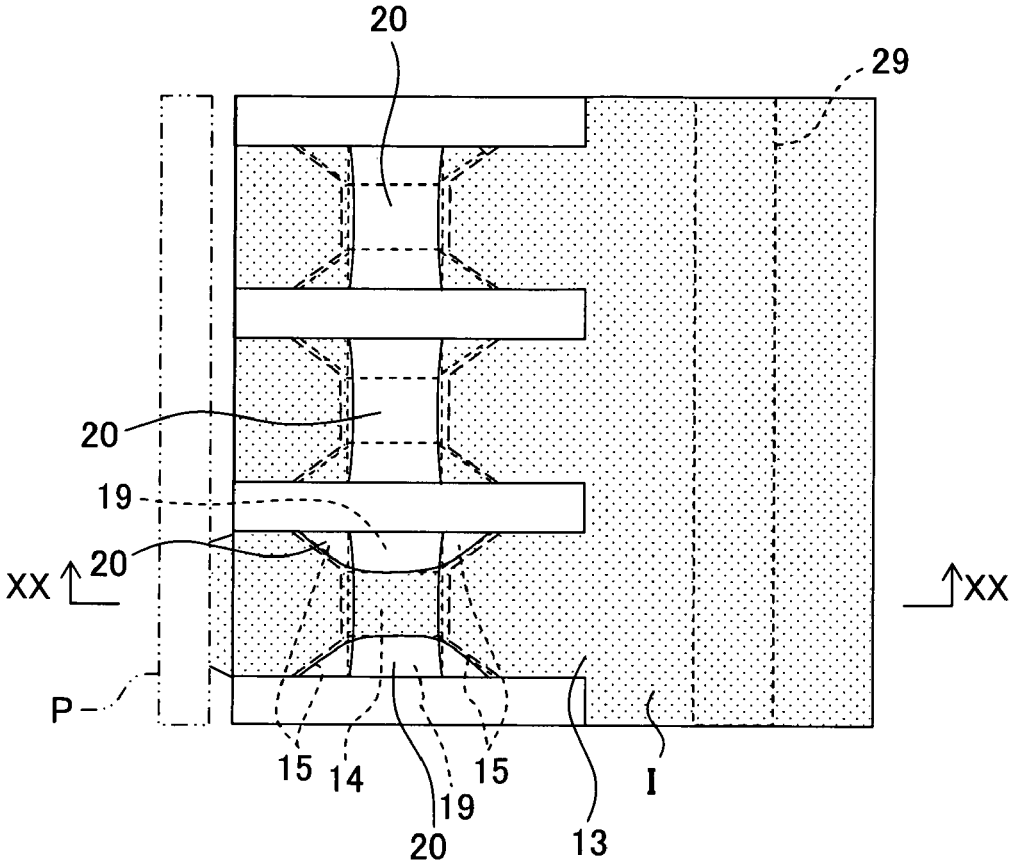
FIG. 19 is a diagram showing a status in which a part of the ink channels of the recording head is opened.
Figure 20:
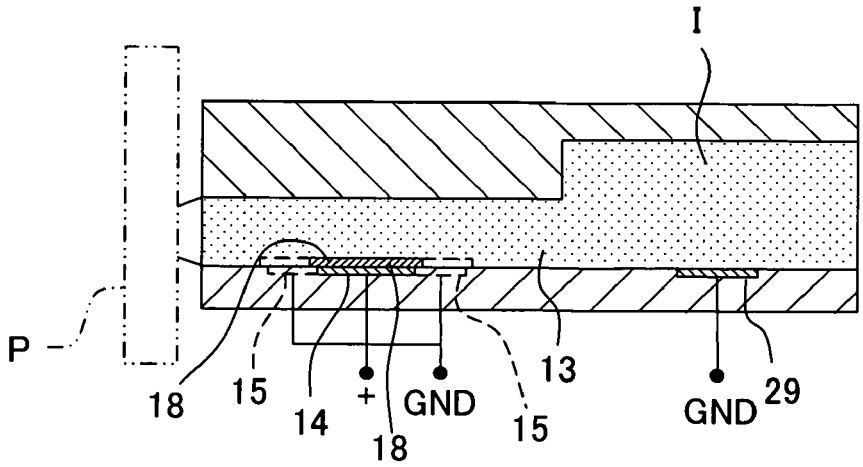
FIG. 20 is a cross-sectional view taken along a line XX-XX in FIG. 19.

Thus, in a case in which each of the ink channels 13 is closed by the bubble 20, and then, for example, the lowermost ink channel 13 in FIG. 13 is opened to transport the ink I from the lowermost ink channel 13, an opening time $T_o$ of the ink channel 13 is determined based on the ink flow amount F determined by the ink-flow amount determining section 66 (step S20); and the electrode to which the voltage is to be applied is changed from the second individual electrodes 15 to the first individual electrode 14, and the voltage is applied to the first individual electrode 14 by the driver IC 16 (step S 21). As the voltage is applied to the first individual electrode 14, the wetting angle of the ink I is decreased on the surface of the insulating film 18 on the surface of the first individual electrode 14 to which the voltage is applied, thereby lowering the liquid-repellent property, and the ink I can be moved to the surface of this insulating film 18. On the other hand, the liquid-repellent property is increased on the insulating film 18 on the surface of the second individual electrodes 15 to which the voltage is not applied. Therefore, as shown in FIG. 19 and FIG. 20, the ink moves in the area in which the first individual electrode 14 is formed, and at the same time, the bubble 20 positioned in that area to close the ink channel 13 are divided into two bubbles and move to both sides in the width direction. Accordingly, the two bubbles divided from the bubble 20 are positioned on the surfaces of the high liquid-repellent areas 19 and on the area in which the second individual electrodes 15 are formed, respectively. Therefore, an upstream area and a downstream area of the area in which the first individual electrode 14 is formed are communicated with each other, the ink channel 13 is opened, and the ink I is transported onto the recording paper P.

Furthermore, when the voltage is applied to the first individual electrode 14 and the opening time $T_o$ determined at step S20 has elapsed after the ink channel 13 is opened (Yes at step S22), the electrode to which the voltage is to be applied is changed from the first individual electrode 14 to the second individual electrodes 15, and the voltage is applied to the second individual electrodes 15 by the driver IC 16 (step S23). As the voltage is applied to the second individual electrodes 15, the wetting angle of the ink I is decreased on the insulating film 18 on the surface of the first individual electrode 14, thereby increasing the liquid-repellent property once again, and the ink I cannot be moved to the surface of this insulating film 18. At the same time, since the liquid-repellent property is decreased on the insulating film on the surface of the second individual electrodes 15, as shown in FIG. 17 and FIG. 18, the bubble 20 moves from the area in which the second individual electrodes 15 are formed to the area in which the first individual electrode 14 is formed, and the ink channel 13 is closed by the bubble 20. Thus, the desired flow amount F of the ink I can be transported onto the recording paper P from the ink channel 13 by opening and closing the ink channel 13.

According to the recording unit 3 described above, the following effects can be achieved.

The pump 2 repeatedly performs applying the voltage to the electrode 27 and releasing the voltage applied to the electrode 27 to change the wetting angle of the ink I on the surface of the insulating film 28, thereby moving the ink I inside the pressure adjustment channel 26 so as to pressurize the ink I inside the ink pressurizing channel 21. Therefore, the structure of the pump 2 is simplified without including any movable parts and the manufacturing cost can be reduced. Moreover, as compared to the conventional pumps, the noise and energy consumption of the pump 2 during the operation is reduced.

The ink I inside the recording head 1 and the pump 2 is held at the ground potential all the time by the common electrode 29 provided in the manifold 12. Therefore, in the recording head 1, when the voltage is applied to the first individual electrode 14 or the second individual electrodes 15, the wetting angle of the ink I on the insulating film 18 on the surface of the first individual electrode 14 and the second individual electrodes 15 is decreased, and the liquid-repellent property is lowered assuredly. Moreover, in the pump 2, when the voltage is applied to the electrode 27, the wetting angle of the ink I on the insulating film 28 on the surface of the electrode 27 is decreased assuredly. Therefore, it is possible to supply assuredly the ink I to the recording head 1 by the pump 2 and to transport assuredly the ink I by the recording head 1 while decreasing, as much as possible, the voltage applied to the first individual electrode 14, the second individual electrodes 15, and the electrode 27.

Next, modified embodiments in which various modifications are made in the second embodiment will be described. However, the same reference numerals will be used for components having an identical structure as the components in the second embodiment and the description of such components will be omitted.

First Modified Embodiment

Figure 21:
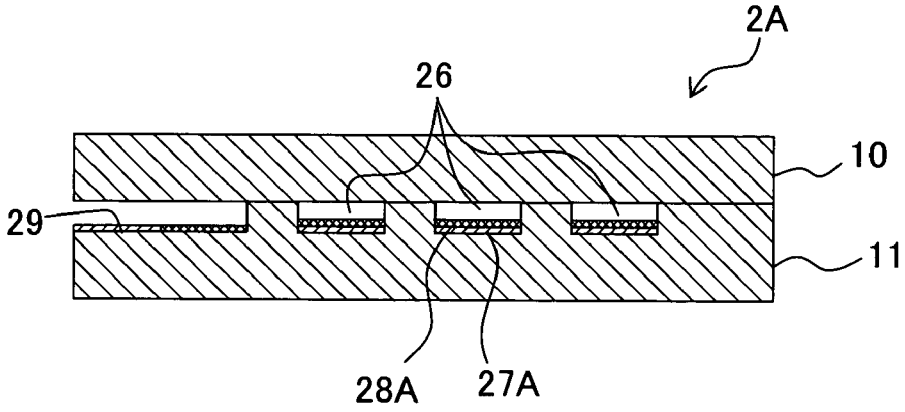
FIG. 21 is a cross-sectional view of a first modified embodiment corresponding to FIG. 9.

An electrode of the pump is not required to be formed necessarily on the bottom surface and two side surfaces of the wall surface which form the pressure adjustment channel, and the electrode may be formed, for example, on only one of the bottom surface and the side surface. However, as shown in FIG. 21, in a pump 2A, in which a channel cross-section of the pressure adjustment channel 26 is rectangular in shape, for the purpose of generating the capillary force effectively by further widening an area of an insulating film 28A, it is desirable that an electrode 27A is formed on a wall surface (bottom surface) corresponding to a longer side of the rectangle rather than on a wall surface (side surface) corresponding to a shorter side of the rectangle.

Second Modified Embodiment

Figure 22:
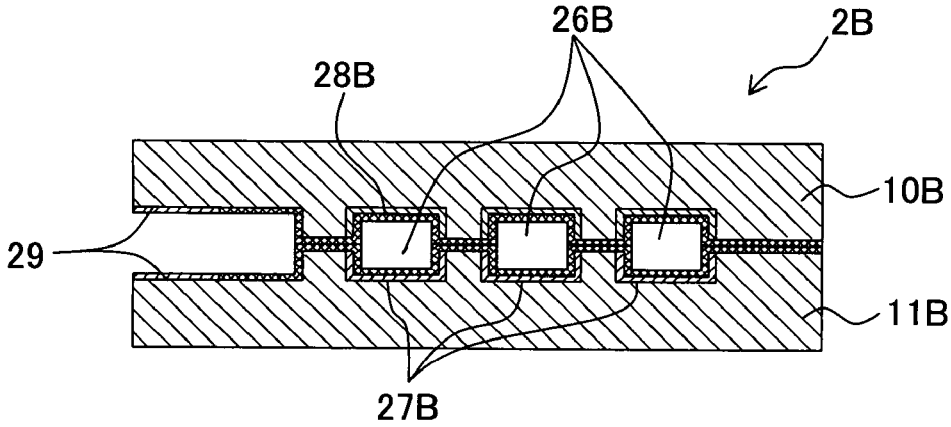
FIG. 22 is a cross-sectional view of a second modified embodiment corresponding to FIG. 9.

Further, the electrode and the insulating layer may be formed to cover an entire wall surface which forms the pressure adjustment channel. For example, in a pump 2B in FIG. 22, a recess is formed by etching in each of a first channel forming member 10B and a second channel forming member 11B, and a pressure adjustment channel 26B is formed between these two recesses. An electrode 27B and an insulating layer 28B are formed to cover the entire wall surface which forms the pressure adjustment channel 26B (inner surface of the two recesses). In this case, as compared to the pump 2 in the second embodiment, an area of the electrode 27B is greater. Accordingly, the capillary force is developed even more effectively when the voltage is applied to the electrode 27B and the driving force of the pump is increased. Therefore, the ink I can be transported efficiently to the head 1.

Third Modified Embodiment

Figure 23:
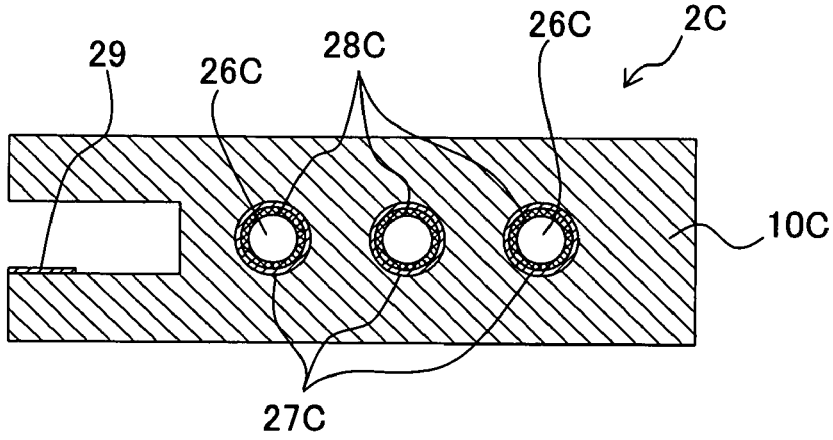
FIG. 23 is a cross-sectional view of a third modified embodiment corresponding to FIG. 9.

The channel cross-section of the pressure adjustment channel is not restricted to be rectangular in shape and may have other shapes. For example, as shown in FIG. 23, in a pump 2C, a pressure adjustment channel 26C with a channel cross-section having a circular shape is formed in a channel forming member 10C. An electrode 27C is formed over an entire circumference of a wall surface which forms the pressure adjustment channel 26C, and furthermore, an insulating film 28C is formed on a surface of the electrode 27C. In this case, as compared to a case of the channel cross-section having a rectangular shape, when a predetermined voltage is applied to the electrode 27C, the capillary force is generated more effectively in the pressure adjustment channel 26C, and the driving force of the pump is increased. Therefore, the ink I can be transported efficiently to the head 1.

Fourth Modified Embodiment

Figure 24:
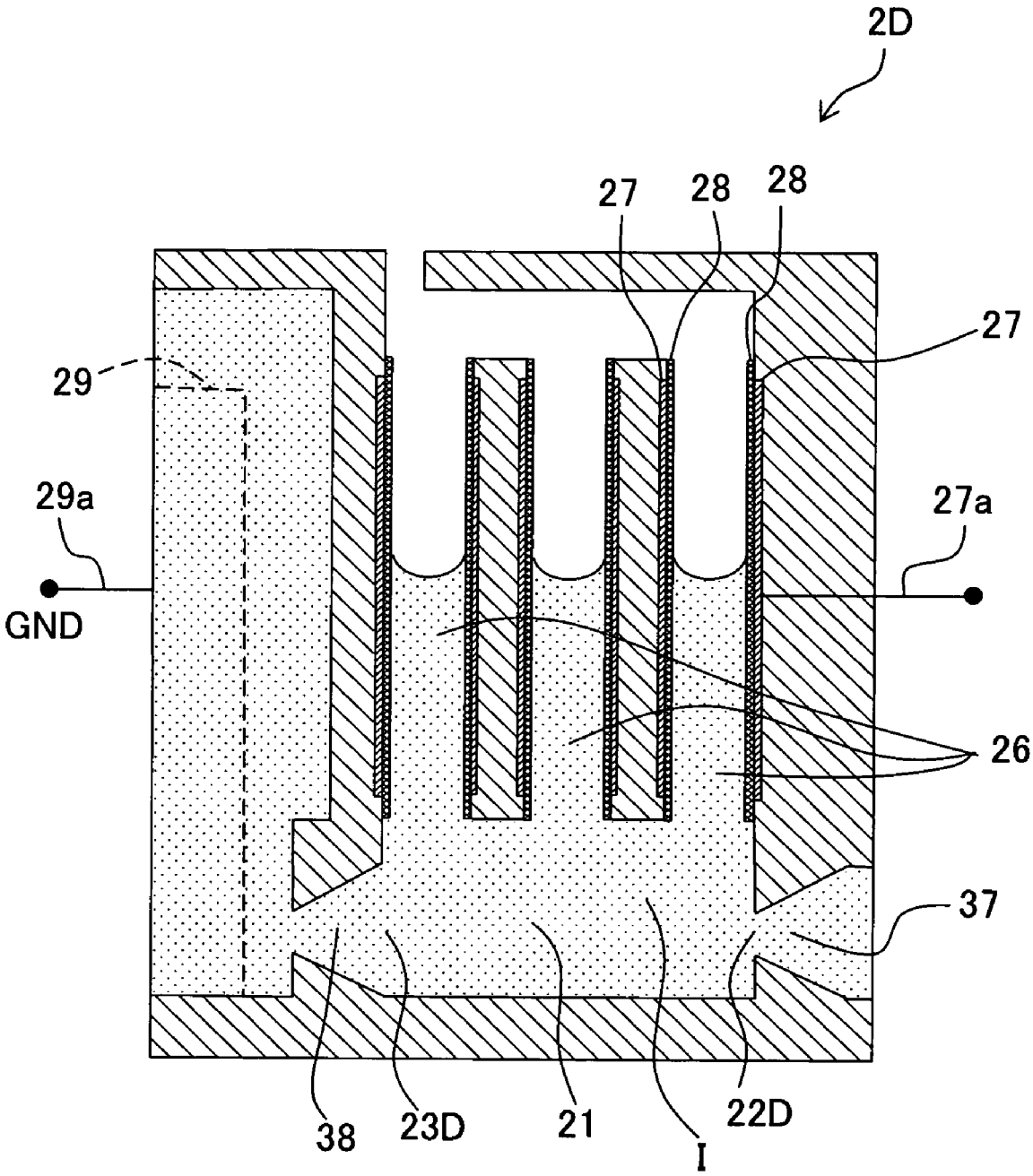
FIG. 24 is a cross-sectional view of a fourth modified embodiment corresponding to FIG. 8.

The reverse flow preventing mechanism which prevents the reverse flow of the ink through the inlet port and the outlet port is not limited to the first valve member 24 and the second valve member 25 (see FIG. 8) in the second embodiment. For example, in a pump 2D of a fourth modified embodiment shown in FIG. 24, an inlet channel 37 which communicates with an inlet port 22D is formed near the inlet port 22D. The inlet channel 37 is formed to become narrower in a tapered shape, with its channel area decreasing gradually, toward the ink pressurizing chamber 21 (toward left side in FIG. 24). Moreover, an outlet channel 38 which communicates with an outlet port 23D is formed near the outlet port 23D. The outlet channel 38 is formed to become wider in a tapered shape, with its channel area increasing gradually, toward the ink pressurizing chamber 21 (toward right side in FIG. 24). In this case, a channel resistance in the inlet channel 37 when there is an inflow of the ink I through the inlet port 22D to the ink pressurizing chamber 21 is smaller than a channel resistance in the inlet channel 37 when there is an outflow of the ink I from the ink pressurizing chamber 21 through the inlet port 22D. Accordingly, there is hardly any reverse flow of the ink I from the ink pressurizing chamber 21 through the inlet port 22D. Moreover, a channel resistance in the outlet channel 38 when there is an outflow of the ink from the ink pressurizing chamber 21 through the outlet port 23D is smaller than a channel resistance when there is an inflow of the ink through the outlet port 23D to the ink pressurizing chamber 21. Accordingly, there is hardly any reverse flow of the ink through the outlet port 23D to the ink pressurizing chamber 21.

Fifth Modified Embodiment

Figure 25:
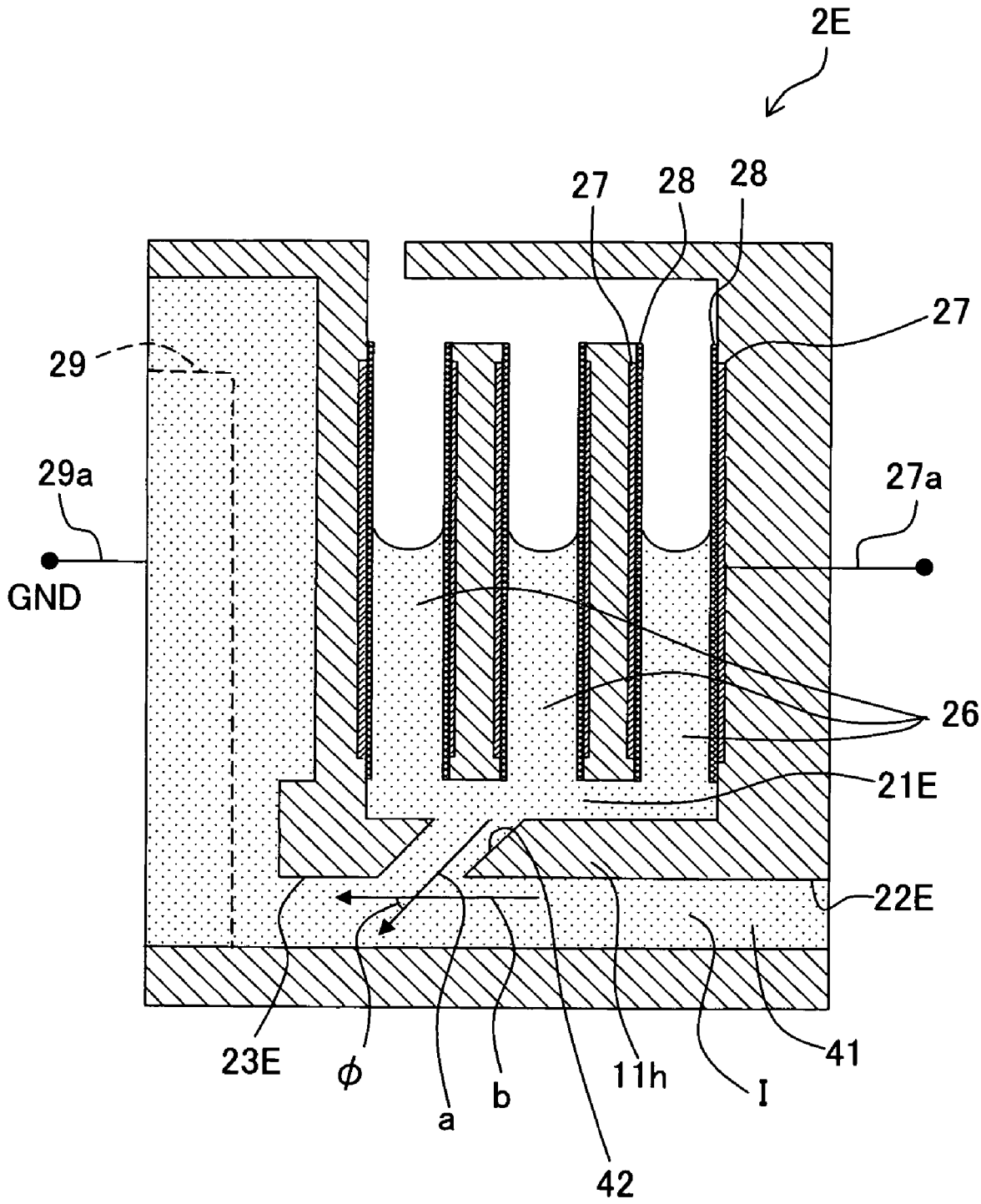
FIG. 25 is a cross-sectional view of a fifth modified embodiment corresponding to FIG. 8.

Moreover, in a pump 2E of a fifth modified embodiment shown in FIG. 25, an ink pressurizing chamber 21E communicating with the pressure adjustment channel 26 and a first channel 41 extending in a front and rear direction (left and right direction in FIG. 25) and connecting an inlet port 22E and an outlet port 23E are separated by a partition wall 11*h*. A second channel 42 extending forward in an inclined direction from the ink pressurizing chamber 21E and joined to the first channel 41 is formed in the partition wall 11*h*. A direction of flow of the ink I flowing in the second channel 42 from the ink pressurizing chamber 21E toward the first channel 41 (arrow "a") and a direction of flow of the ink I flowing in the first channel 41 from the inlet port 22E toward the outlet port 23E (arrow "b") are at a predetermined acute angle $\phi$.

In this case, when the voltage is applied to the electrode 27, the pressure of the ink pressurizing chamber 21E is decreased and there is an inflow of ink I from both of the inlet port 22E and the outlet port 23E to the ink pressurizing chamber 21E through the first channel 41 and the second channel 42. On the other hand, when the application of the voltage to the electrode 27 is stopped, the pressure of the ink pressurizing chamber 21E is increased and the ink I moves from the ink pressurizing chamber 21E to the second channel 42 and the first channel 41. At this time, since the second channel 42 is inclined toward a direction (forward direction) heading from the inlet port 22E to the outlet port 23E, in the vicinity of a joining section of the second channel 42 and the first channel 41, the ink I which is inflowed from the second channel 42 into the first channel 41 tends flow to the outlet port 23E in the forward direction. Moreover, when the ink inflows from the second channel 42 to the first channel 41, a vortex is developed in the joining section of the first channel 41 with the second channel 42, at a side of the inlet port (right side in FIG. 25), and the ink I hardly flows to the inlet port 22E disposed in the backward direction. Therefore, the reverse flow of the ink I in the first channel 41 in the backward direction is prevented.

Similar to the second embodiment, modifications such as the modifications in the channel cross-section shape of the pressure adjustment channel 96 as described above, can be made in the pump 73 of the first embodiment.

Although the first embodiment and the second embodiment are examples in which the present invention is applied to a pump which pressurizes ink, the present invention can also be applied to a pump which transports a liquid having conductivity other than ink such as a pump which transports a liquid such as a medicinal solution or a biochemical solution inside a micro total-analyzing system (μTAS), and a pump which transports a liquid such as a solvent and a chemical solution inside a micro chemical system.

In the embodiments mentioned above, the pump is provided with the first voltage applying unit. However, an external voltage applying unit which is outside the pump can be used. Moreover, the recording unit is provided with the second voltage applying unit. However, in this case also, an external voltage applying unit which is outside the recording unit can be used. Furthermore, each of these voltage applying units may be a mere power supply or power source.

Third Embodiment

Figure 26A:
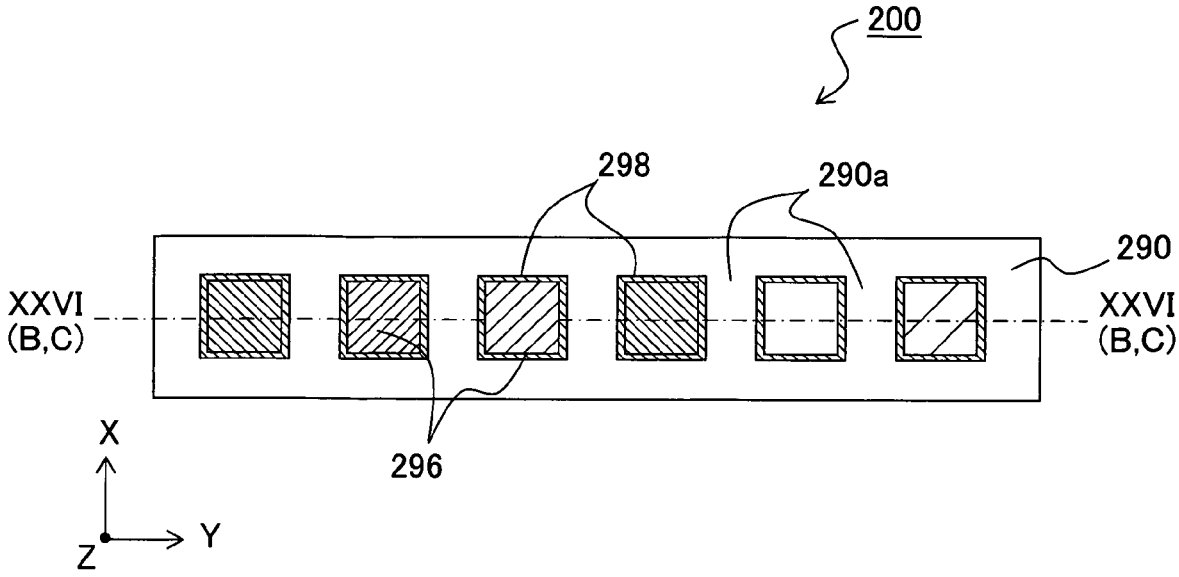
FIG. 26A is a plan view of a graph display apparatus of a third embodiment.
Figure 26B:
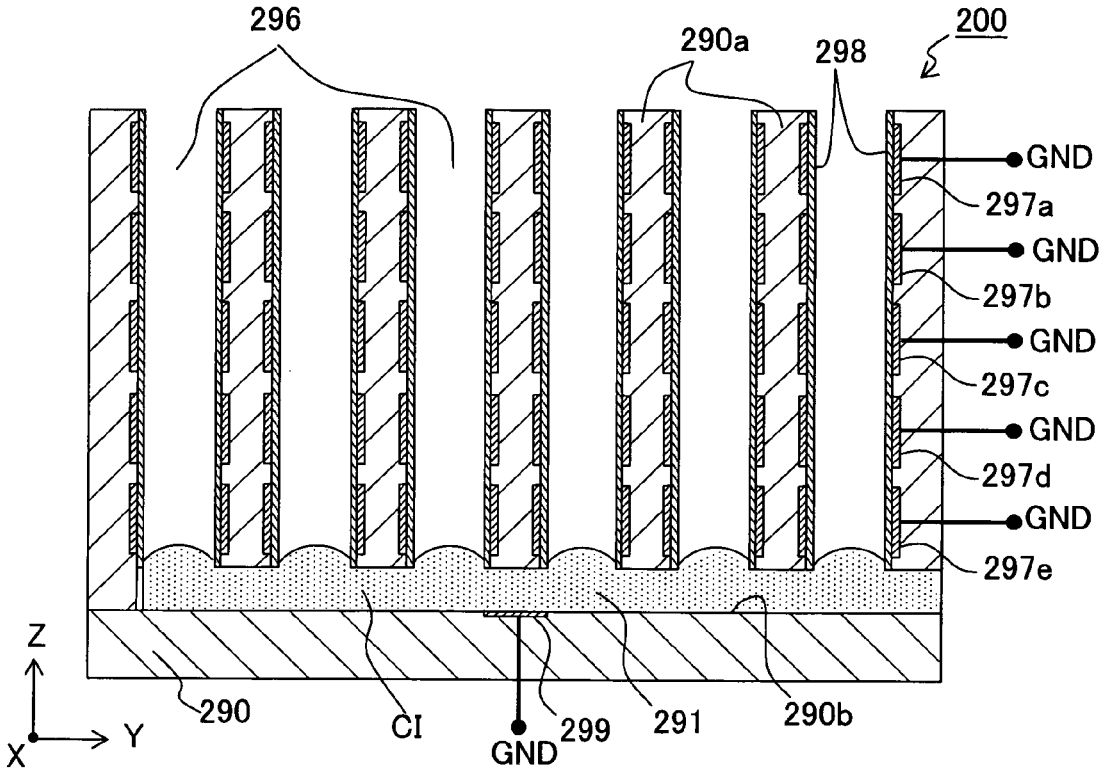
FIG. 26B is a cross-sectional view of the graph display apparatus when no voltage is applied to electrodes, taken along a line XXVIB-XXVIB in FIG. 26A.
Figure 26C:
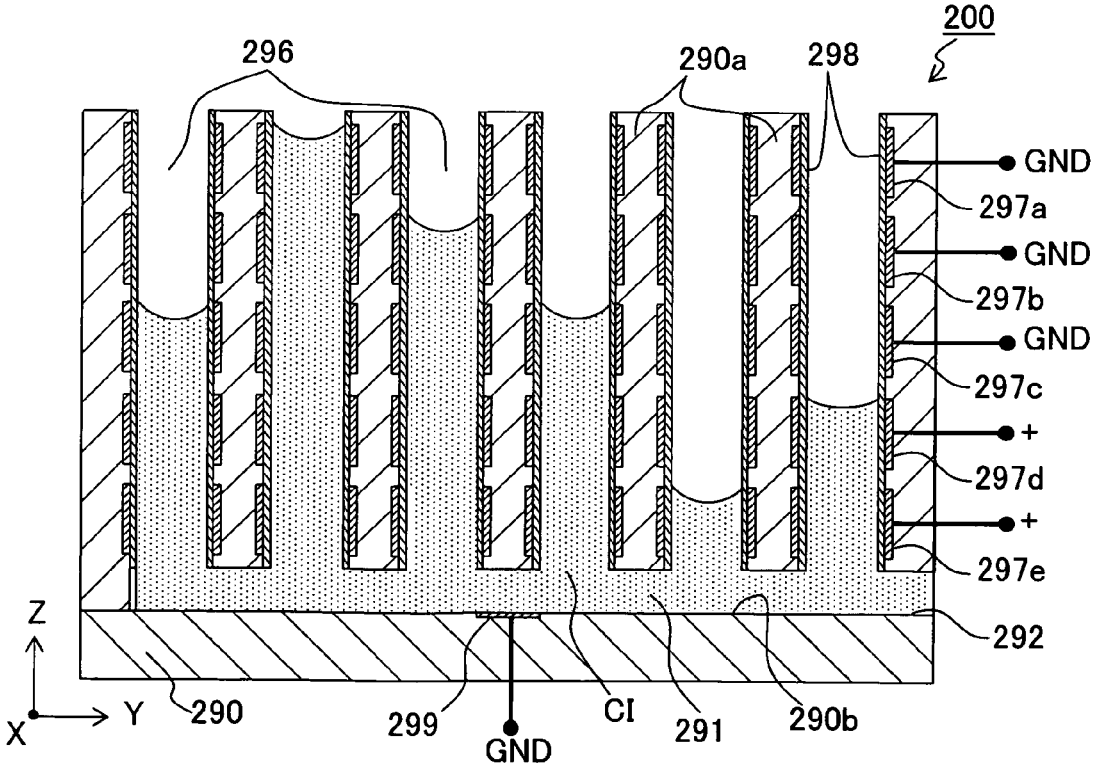
FIG. 26C is a cross-sectional view of the graph display apparatus when voltage is applied to a part of the electrodes, taken along a line XXVIC-XXVIC in FIG. 26A.

In a third embodiment, a graph display apparatus which is an embodiment of the liquid moving apparatus of the present invention will be described with reference to FIG. 26A to FIG. 26C. A graph display apparatus 200 includes a housing 290 made of a transparent material, a colored liquid having conductivity (conductive colored liquid CI) filled in the housing 290, a tank (not shown in the diagram) for the conductive colored liquid, and a channel (not shown in the diagram) connecting the tank and the housing 290. The housing 290 is rectangular parallelepiped in shape. A common liquid channel 291 extending in a Y direction is formed on a lower portion (bottom portion) in the housing 290 and a bottom surface 290*b* inside the housing 290 is defined by the common liquid channel 291. Six individual liquid channels 296 each communicating with the common liquid channel 291 are formed extending in a Z direction in the housing 290. The six individual liquid channels 296 are arranged in the Y direction separated from each other by a predetermined interval, and partition walls 290*a* are formed between the adjacent individual liquid channels 296. Each individual liquid channel 296, as shown in FIG. 26A, has a rectangular cross section in an XY plane. An insulating film 298 having the liquid-repellent property is provided on a wall surface of the partition wall 290*a* and a wall surface of the housing 290 which define each of the individual liquid channels 296. Furthermore, five electrodes 297*a* to 297*e* arranged in a row in a Z direction separated from each other at a predetermined interval are provided on an inner side of the insulating film 298, namely between the insulating film 298 and the wall surface of the housing 290 and the partition wall 290*a*. These electrodes 297*a* to 297*e* are connected to respective voltage sources which are not shown in the diagram and a voltage can be applied independently to each of these total 30 electrodes. Each of the partition walls 290*a* is not in contact with the bottom surface 290*b* of the housing 290 due to a presence of the common liquid channel 291, and each of the individual liquid channels 296 communicates with the common liquid channel 291 formed at the bottom portion of the housing 290. Furthermore, the common liquid channel 291 communicates with a tank which is not shown in the diagram, via a liquid supply port 292 provided at an end portion in the Y direction of the bottom portion of the housing 290. A ground electrode 299 is provided at a central portion of the bottom surface 290*b* of the housing 290, and is held at a ground potential by being connected to the ground.

Next, an operation of the graph display apparatus will be explained. First, the conductive colored liquid CI is supplied to the graph display apparatus 200 from the tank not shown in the diagram, via the liquid supply port 292. At this time, the electric potential of the electrodes 297*a* to 297*e* and the ground electrode 299 is held at the ground potential. Since a wall surface of each of the individual liquid channels 296 is covered by the insulating film 298 having the liquid-repellent property, due to the capillarity, a liquid level of the conductive colored liquid CI in each of the individual liquid channels 296 becomes lower than a liquid level in the tank, and is positioned at the lowest surface of each of the individual liquid channels 296 (see FIG. 26C). The wetting angle of the liquid level at this time is greater than 90°.

When a predetermined voltage is applied to the electrode 297*e*, due to the CEW phenomenon as described above, a wettability of the insulating film 298 in an area covering the electrode becomes higher, the wetting angle with the liquid level becomes less than 90°, and the liquid level rises up to a position at an upper end of the electrode 297*e*. Furthermore, when a predetermined voltage is applied to the electrode 297*d*, the height of the liquid level rises up to a position at an upper end of the electrode 297*d*. Similarly, by applying a predetermined voltage to the electrodes 297*c* to 297*a*, the height of the liquid level can be raised up to a position at an upper end of the electrodes 297*c* to 297*a* respectively. Conversely, by making the voltage applied to the electrodes 297*a* to 297*a* to be zero in order starting from the upper electrode, the height of the liquid level can be lowered to a position at a lower end of the electrodes 297*a* to 297*e* respectively.

Accordingly, it is possible to set independently the height of the liquid level of the conductive colored liquid CI in each of the individual liquid channels 296. Since the housing 290 is formed of a transparent member, the height of the liquid level of each of the individual liquid channels 296 can be checked visually by viewing from the X direction. Therefore, a bar graph can be displayed by the graph display apparatus 200 of the third embodiment.

Sixth Modified Embodiment

Figure 27A:
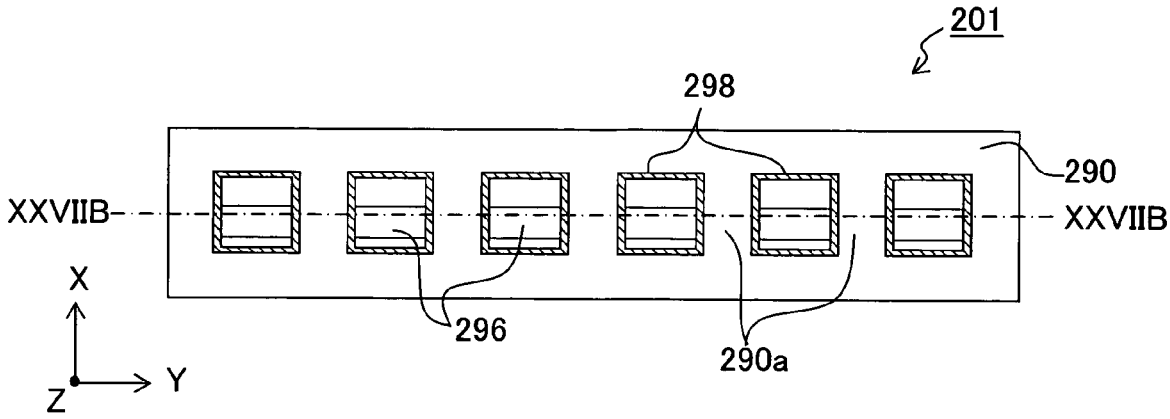
FIG. 27A is a plan view of a graph display apparatus of a sixth modified embodiment.
Figure 27B:
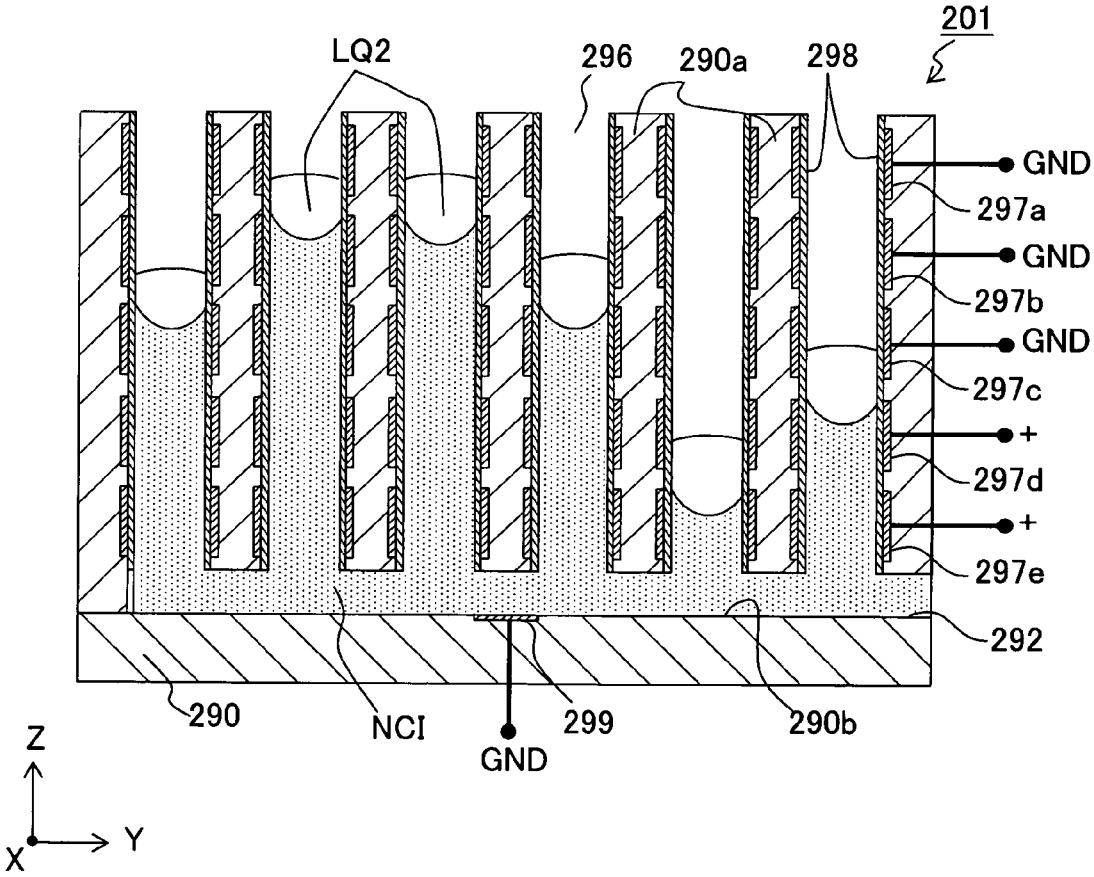
FIG. 27B is a cross-sectional view of the graph display apparatus of the sixth modified embodiment taken along a line XXVIIB-XXVIIB in FIG. 27A.

A display apparatus 201 of a sixth modified embodiment is similar to the graph display apparatus 200 of the third embodiment except that a colorless conductive liquid NCI is used instead of the conductive colored liquid CI, and a small amount of a second liquid LQ2 is added on a liquid level of the colorless conductive liquid NCI in each of the individual liquid channels 296. The second liquid LQ2 has a specific gravity lower than a specific gravity of the colorless conductive liquid NCI and is separated from the colorless conductive liquid NCI when mixed and settled with the colorless conductive liquid NCI. As shown in FIG. 27A and FIG. 27B, since only the second liquid LQ2 positioned at the uppermost portion of the liquid level in each of the individual liquid channels 296 is colored, it is possible to display in the form of a line graph. Moreover, as in a case where the colorless conductive liquid NCI is water and the second liquid is an oil-based ink, for example, when the second liquid LQ2 is a nonvolatile liquid, it is possible to prevent drying of the colorless conductive liquid NCI.

In the sixth modified embodiment, the second liquid is a colored liquid. However, the second liquid may be a colorless liquid. Furthermore, the conductive colored liquid CI may be used instead of the colorless conductive liquid NCI. In the third embodiment and the sixth modified embodiment, a color and a degree of transparency of the conductive colored liquid and the second liquid may be arbitrary. Moreover, the housing of the graph display apparatus is formed of the transparent member. However, only a part or portion of the housing may be transparent to the extent that at least the liquid level of the liquid in each of the individual liquid channels can be observed.

Fourth Embodiment

Figure 28A:
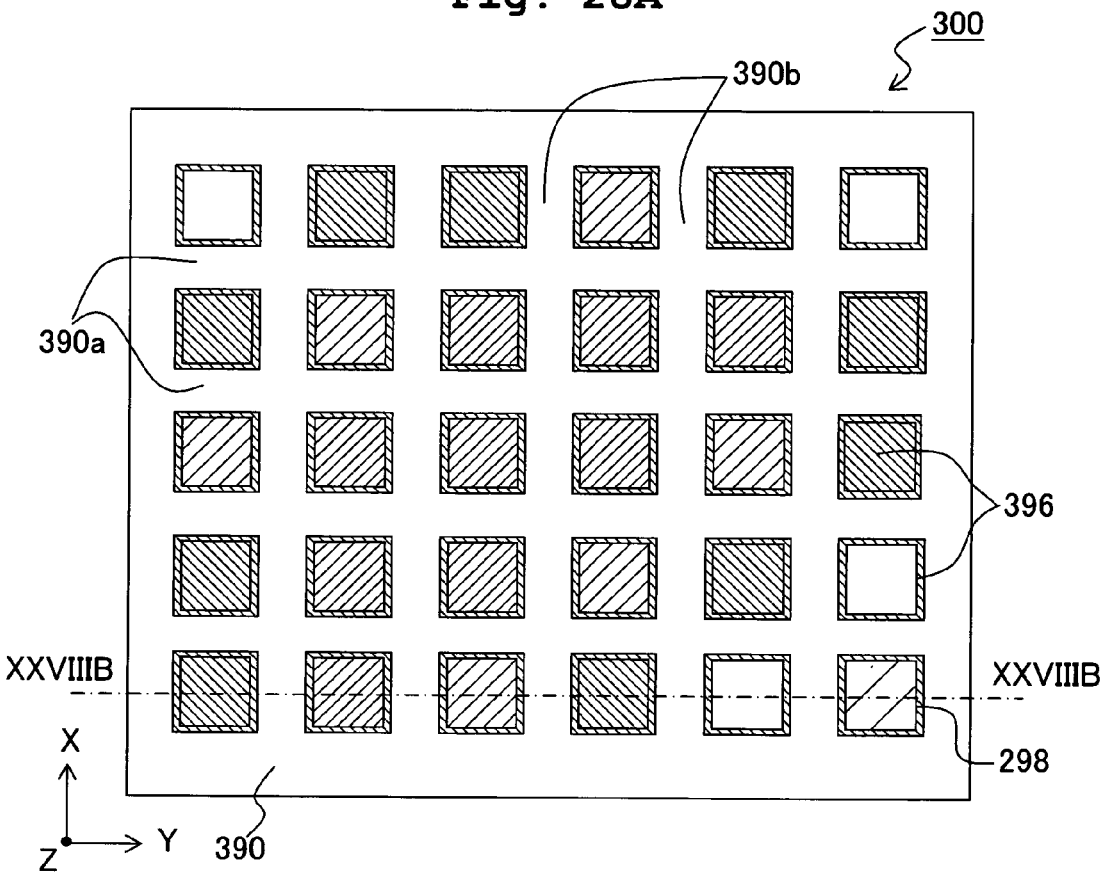
FIG. 28A is a plan view of a matrix display apparatus of a fourth embodiment.
Figure 28B:
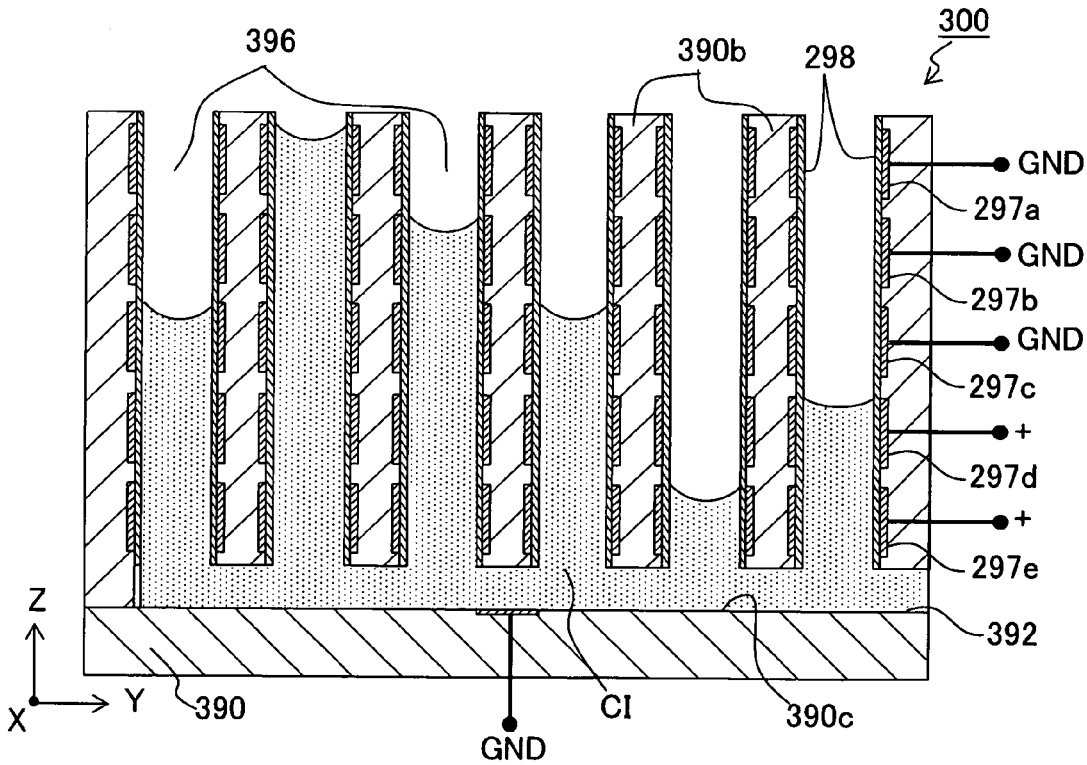
FIG. 28B is a cross-sectional view of the matrix display apparatus taken along a line XXVIIIB-XXVIIIB in FIG. 28A.

In a fourth embodiment, a matrix display apparatus which is an embodiment of the liquid moving apparatus of the present invention will be described with reference to FIG. 28A and FIG. 28B. The matrix display apparatus of the fourth embodiment has a structure similar to the structure of the graph display apparatus of the third embodiment except that a plurality of individual liquid channels are formed in the form of a matrix in a housing having a substantially square shape in a plan view. A matrix display apparatus 300 of the fourth embodiment includes a housing 390 having a substantially square shape as viewed in a plan view. A bottom surface 390*c* of the housing 390 is formed of a transparent member. The housing 390 is divided into 5×6 matrix form by four horizontal partition walls 390*a* extending in the Y direction and five vertical partition walls 390 extending in the X direction, and each matrix forms an individual liquid channel 396. As shown in FIG. 28B, neither of the horizontal partition walls 390*a* and the vertical partition walls 390*b* are extended up to the bottom surface 390*c* of the housing 390 and the individual liquid channels 396 communicate with each other through a common liquid channel 391. Moreover, each of the individual liquid channels 396 is connected to a tank, which is not shown in the diagram, through a liquid supply port 392 formed at an end portion (lower right portion in FIG. 28A) in the Y direction of the housing 390, and the conductive colored liquid CI is supplied through a channel not shown in the diagram.

In the matrix display apparatus of the fourth embodiment, it is possible to adjust the height of the liquid level of the conductive colored liquid in each of the individual liquid channel 396 by a method similar to the method for adjusting the height of the liquid level of the liquid in each of the individual liquid channels in the graph display apparatus of the third embodiment. Since the bottom surface 390*c* of the housing 390 is formed of the transparent member, light can be irradiated from a side of the bottom surface 390*c* to be transmitted to a side of a top surface. In this case, since an amount of light transmitting through varies according to the height of the liquid level of the conductive colored liquid CI in each of the individual liquid channels 396, it can be recognized as a difference in shades of light. Using this phenomenon, it is possible to use the matrix display apparatus of the fourth embodiment as a type of a display apparatus.

Seventh Modified Embodiment

Figure 29A:
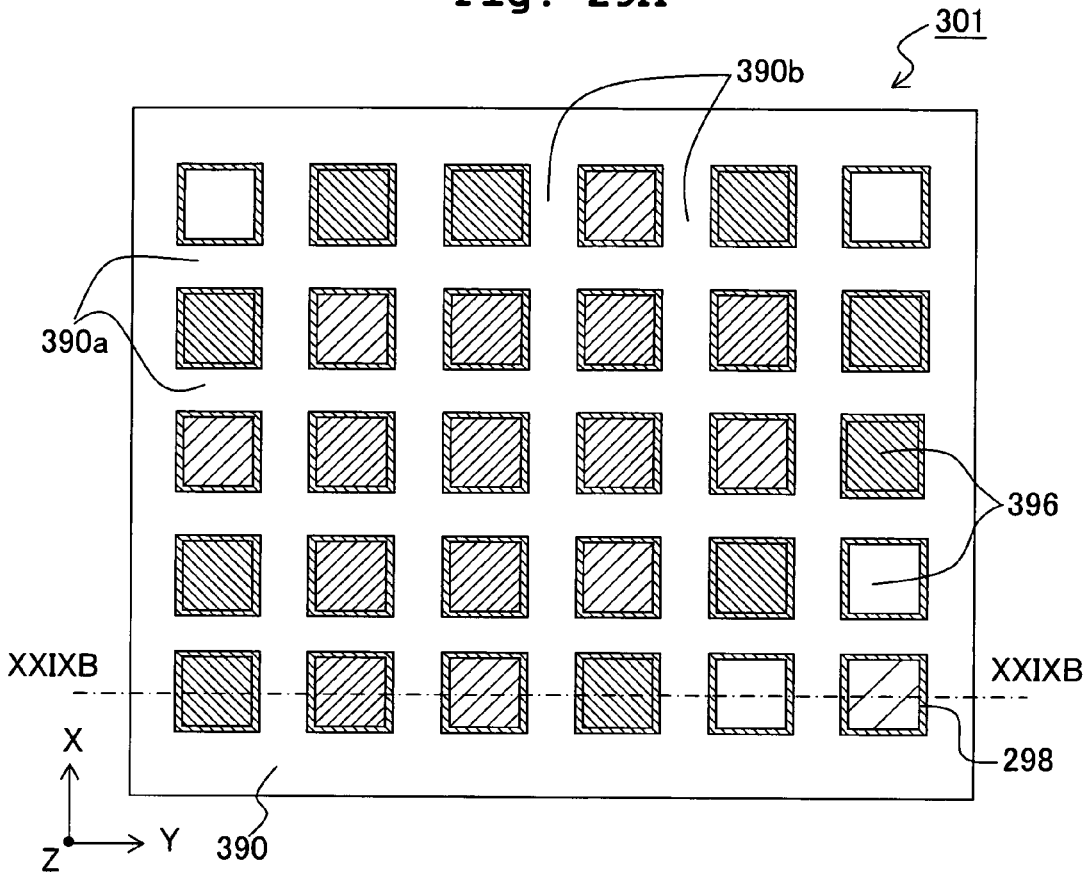
FIG. 29A is a plan view of a graph display apparatus of a seventh modified embodiment.
Figure 29B:
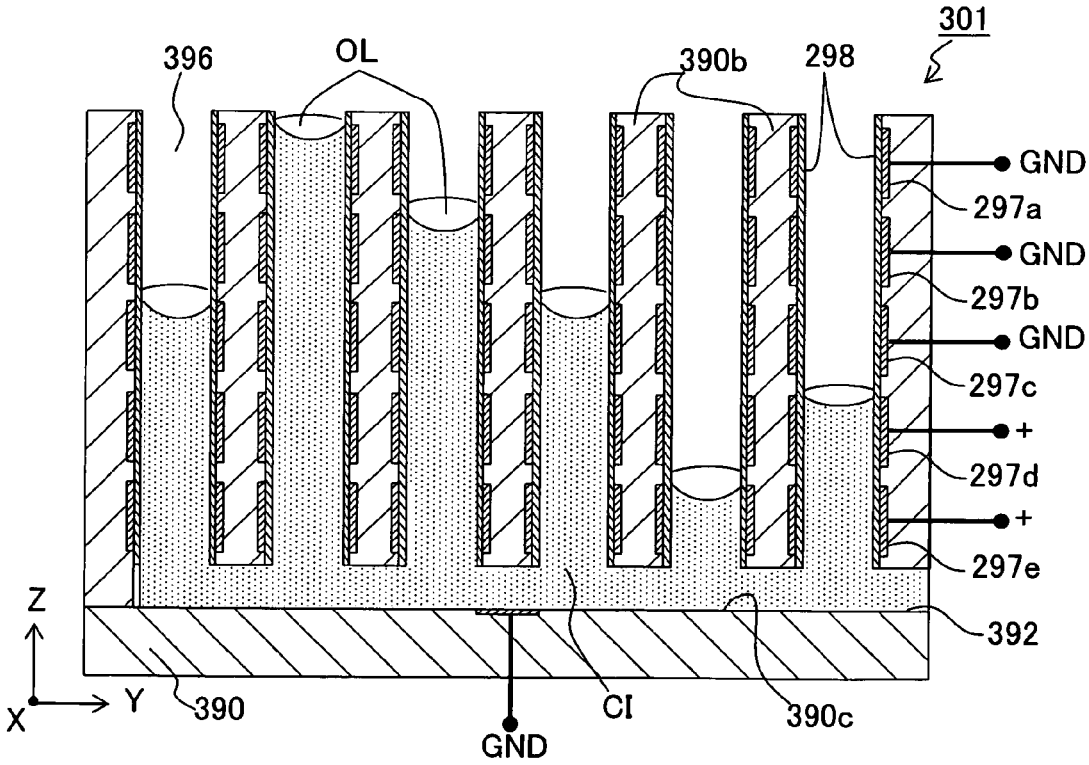
FIG. 29B is a cross-sectional view of the graph display apparatus of the seventh modified embodiment taken along a line XXIXB-XXIXB in FIG. 29A.

A matrix display apparatus of a seventh modified embodiment is similar to a graph display apparatus of the fourth embodiment except for points that a small amount of an oil-based liquid OL is added on a liquid level of the conductive colored liquid CI in each individual liquid channel (see FIG. 29A and FIG. 29B). The oil-based liquid OL has a specific gravity lower than a specific gravity of the conductive colored liquid, and is separated from the conductive colored liquid CI when mixed and settled with the conductive colored liquid CI, and is nonvolatile. As in the seventh modified embodiment, by adding the small amount of the transparent nonvolatile oil-based liquid OL on the liquid level of the conductive colored liquid CI in each of the individual liquid channels 396, it is possible to prevent the evaporation of the conductive colored liquid CI.

The oil-based liquid OL in the seventh modified embodiment may not be colorless and transparent, and the color and the degree of transparency of the oil-based liquid OL may be arbitrary provided that the light irradiated from the bottom surface of the housing can be transmitted through the liquid.

In the third and the fourth embodiments and the sixth and the seventh modified embodiments, each of the individual liquid channels is mutually communicated, and the liquid supplied to each of the individual liquid channels is common. However, each of the individual liquid channels may be separated from each other, or a part of the individual liquid channels may be separated from the other individual liquid channels. Further, different types of liquids having conductivity (such as liquids having different colors and different degree of transparency) may be supplied to each of the independent individual liquid channels from separate tanks, respectively.

Figure 30A:
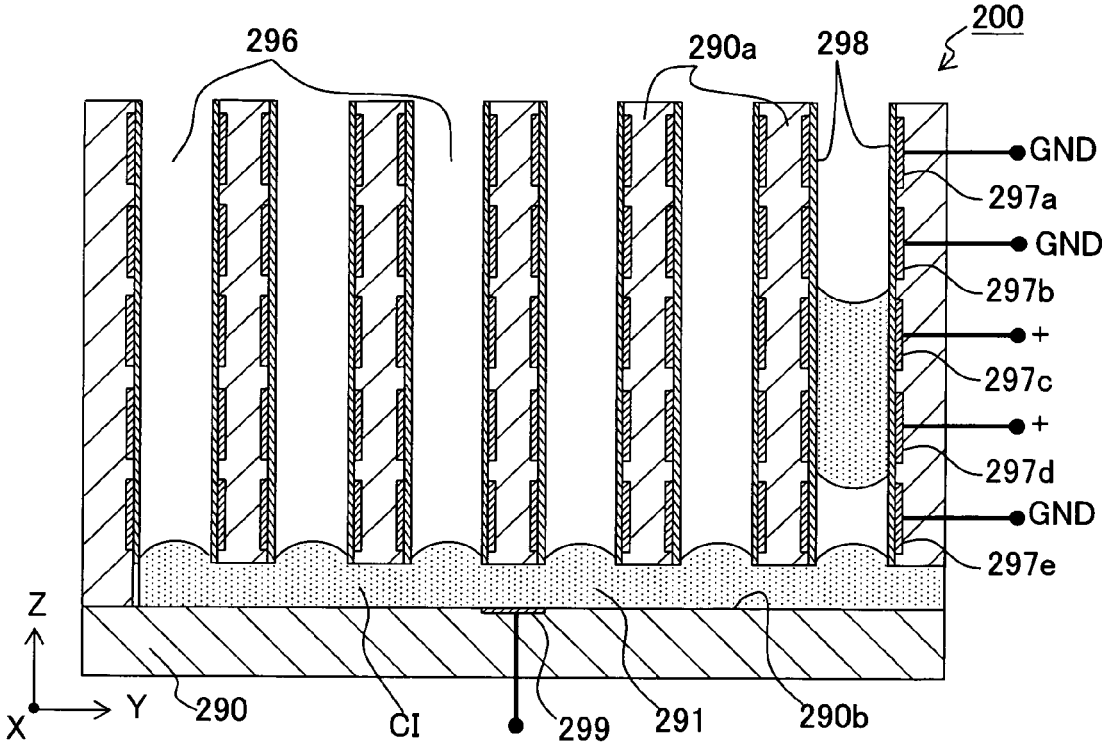
FIG. 30A is across-sectional view when a voltage is applied selectively to electrodes 297*c* to 297*d* of the graph display apparatus of the third embodiment.
Figure 30B:
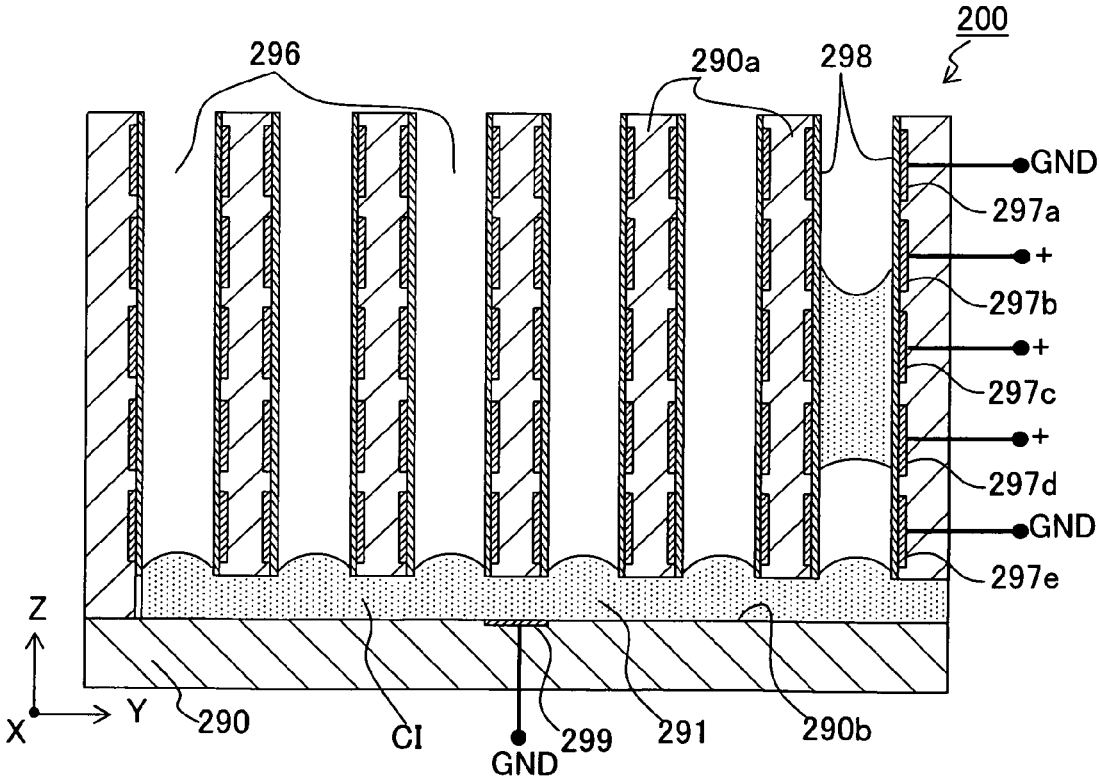
FIG. 30B is across-sectional view when a voltage is applied selectively to electrodes 297*b* to 297*d;*

Each of the display apparatuses of the embodiments and the modified embodiments mentioned above can be used for application of transporting a fluid, a solid matter, a material, a medicine, and food by using an individual channel (capillary tube). Here, the fluid means a liquid having conductivity, the second liquid, a material in the form of a sol or a gel, and a gas. Moreover, each of the display apparatuses does not include a voltage applying unit which applies voltage to an electrode but instead uses an external voltage applying unit. However, each of the display apparatuses may include the voltage applying unit. Furthermore, other than using a mere power supply, a driver IC or the like may be used as the voltage applying unit. Moreover, It is possible to transport selectively a desired amount of liquid by applying the voltage selectively to the electrode provided to each of the individual liquid channels. For example, in the third embodiment, after raising the liquid level of the liquid CI up to a position of the electrode 297*c* by applying the voltage to the three electrodes, for example, the electrode 297*c* to 297*e*, when the voltage of electrode 297*c* is made to be zero, a lump of the liquid CI is remained only in a portion in the individual liquid channel corresponding to the electrodes 297*d* to 297*c* (see FIG. 30A). Next, by gradually lowering a voltage applied to the electrode 297*d* while applying a voltage to the electrode 297*b*, there arises a difference in a magnitude of the surface tension on a surface of the liquid CI at both sides in a direction of the channel. Therefore, it is possible to move the lump of the liquid CI toward the electrode 297*b* (see FIG. 30B). In the wall of the housing 290 at the area between the electrode 297*d* and the electrode 297*e*, a through-hole (not illustrated) which communicates with the outside of the housing 290 is provided to equalize the pressure in the space between the lump of the liquid CI and the surface of the liquid CI facing the lump in the individual liquid channel to the pressure in the outside of the housing 290. Each of the individual liquid channels may include more than one through-holes and the position of the through-holes are not limited in the area between the electrode 297*d* and 297*e*. The shape of the through-holes may be defined arbitrary. A closable valve may be provided in each of the through-holes. Furthermore, an inner wall surface which defines the through-hole may be coated by the repelling film.

In the embodiments and the modified embodiments as mentioned above, the number and the arrangement of the capillary tubes (pressure adjustment channels or individual liquid channels) may be arbitrary. For example, there may be one capillary tube (capillary), and it can be arranged in an arbitrary direction including a lateral direction. Moreover, in view of developing the CEW phenomenon, a fluorine-based resin is preferred as the material for the insulating film.

What is claimed is:

1. A pump comprising:

a liquid chamber which stores a liquid having a conductivity and which includes an inlet port through which the liquid flows into the liquid chamber and an outlet port through which the liquid flows out of the liquid chamber;

a reverse-flow preventing mechanism which prevents a flow of the liquid flowing into the liquid chamber through the inlet port and out through the outlet port to an outside of the liquid chamber from reversing;

a pressure adjustment channel which communicates with the liquid chamber and which changes a pressure of the liquid in the liquid chamber;

a first electrode which is provided on a wall surface which defines the pressure adjustment channel; and an insulating film which is provided on a surface of the first electrode and in which, when a predetermined voltage is applied to the first electrode, a wetting angle of the liquid on a surface of the insulating film is decreased to be smaller than a wetting angle of the liquid on the surface of the insulating film when the predetermined voltage is not applied to the first electrode.

2. The pump according to claim 1, further comprising a first voltage applying unit which applies the predetermined voltage to the first electrode.

3. The pump according to claim 2, wherein:

the first voltage applying unit applies the predetermined voltage to the first electrode to move the liquid in the liquid chamber to the pressure adjustment channel, thereby decreasing a pressure in the pressure chamber to suck the liquid into the liquid chamber through the inlet port; and the first voltage applying unit stops to apply the predetermined voltage to move the liquid in the pressure adjustment channel into the liquid chamber, thereby increasing the pressure in the liquid chamber to discharge the liquid out of the liquid chamber through the outlet port.

4. The pump according to claim 2, wherein when the predetermined voltage is applied to the first electrode, the wetting angle of the liquid on the surface of the insulating film is less than 90°, and when the predetermined voltage is not applied to the first electrode, the wetting angle is not less than 90°.

5. The pump according to claim 2, further comprising a second electrode which is held at a predetermined constant electric potential and which is provided in the liquid chamber or in a channel which communicates with the liquid chamber through the inlet port or the outlet port to always make contact with the liquid.

6. The pump according to claim 2, wherein a channel cross-section of the pressure adjustment channel is circular in shape.

7. The pump according to claim 2, wherein a channel cross-section of the pressure adjustment channel is rectangular in shape.

8. The pump according to claim 7, wherein the first electrode and the insulating film are formed on a wall surface among wall surfaces which define the pressure adjustment channel, the wall surface corresponding to a longer side of the rectangular shaped pressure adjustment channel.

9. The pump according to claim 2, wherein the first electrode and the insulating film are formed to cover the wall surface which defines the pressure adjustment channel.

10. The pump according to claim 2, wherein the reverse-flow preventing mechanism includes a first valve member which is provided in the vicinity of the inlet port and which opens the inlet port only when the liquid flows into the liquid chamber through the inlet port, and a second valve member which is provided in the vicinity of the outlet port and which opens the outlet port only when the liquid flows out of the liquid chamber through the outlet port.

11. The pump according to claim 2, wherein the reverse-flow preventing mechanism includes an inlet channel which communicates with the inlet port and which is formed such that a channel area of the inlet channel becomes smaller toward the liquid chamber, and an outlet channel which communicates with the outlet port and which is formed such that a channel area of the outlet channel becomes smaller toward a side opposite to the liquid chamber.

12. The pump according to claim 2, wherein:

the reverse-flow preventing mechanism includes a first channel which connects the inlet port and the outlet port, and a second channel which connects the liquid chamber and the first channel; and the second channel is joined to the first channel, in the vicinity of a joining portion of the second channel with the first channel, such that a direction of flow of the liquid flowing through the second channel from the liquid chamber to the first channel makes an acute angle with a direction of flow of the liquid flowing through the first channel from the inlet port to the outlet port.

13. The pump according to claim 2, which is an ink-supply pump which is connected to a recording head which transports an ink to a recording medium to perform recording, and which supplies ink to the recording head.

14. The pump according to claim 2, which is an ink-circulation pump provided to at least one of two ink channels connecting a recording head which transports an ink to the recording medium to perform recording and an ink-supply source, and which circulates the ink between the recording head and the ink-supply source.

15. A liquid transporting apparatus comprising:

a liquid transporting section having a plurality of transporting channels which transport a liquid in a predetermined direction; and the pump as defined in claim 2 in which the outlet port communicates with the plurality of transporting channels, and which pressurizes the liquid in the predetermined direction, wherein the liquid transporting section includes:

a first channel electrode which is formed on an inner surface of each of the transporting channels;

a second channel electrode which is formed in the vicinity of the first channel electrode formed on the inner surface of each of the transporting channels;

a second voltage applying unit which applies voltage to the first channel electrode and the second channel electrode;

a first insulating film which is provided on a surface of the first channel electrode, and in which, when no voltage is applied to the first channel electrode, a wetting angle of the liquid on a surface of the first insulating film is greater than a wetting angle of the liquid on an area on the inner surface of each of the transporting channels, the area being other than an area in which the first channel electrode and the second channel electrode are formed;

a second insulating film which is provided on a surface of the second channel electrode, and in which, when no voltage is applied to the second channel electrode, a wetting angle of the liquid on a surface of the second insulating film is greater than a wetting angle of the liquid on the area on the inner surface of each of the transporting channels, the area being other than the area in which the first channel electrode and the second channel electrode are formed; and an opening and closing controlling mechanism which causes the second voltage applying unit to apply the voltage to the second channel electrode so that a gas is positioned at least on a surface of the first insulating film, thereby closing the one of transporting channels, and which causes the second voltage applying unit to apply the voltage to the first channel electrode so that the gas is positioned at least on a surface of the second insulating film, thereby opening the one of transporting channels;

wherein the first electrode and the second electrode of the pump, and the first channel electrode and the second channel electrode of each of the transporting channels of the liquid transporting section are formed on a same plane; and wherein the insulating film of the pump, and the first insulating film and the second insulating film of each of the transporting channels of the liquid transporting section are formed on a same plane.

16. A liquid moving apparatus comprising:

a liquid chamber which stores a liquid having a conductivity;

a channel which communicates with the liquid chamber;

a plurality of wall surface electrodes which are provided on a wall surface which defines the channel; and an insulating film which is provided on surfaces of the wall surface electrodes to cover the wall surface, and in which, when a predetermined voltage is applied to the wall surface electrodes, a wetting angle of the liquid on a surface of the insulating film is decreased than a wetting angle of the liquid on the surface of the insulating film when the predetermined voltage is not applied to the wall surface electrodes.

17. The liquid moving apparatus according to claim 16, which is a display apparatus.

18. The display apparatus according to claim 17, wherein the channel includes a plurality of individual channels which are arranged in a line.

19. The display apparatus according to claim 17, wherein the channel includes a plurality of individual channels and the plurality of individual channels are arranged in a form of a matrix.

20. The display apparatus according to claim 17, further including a second liquid, which does not mix with the liquid having conductivity, on a liquid level of the liquid having conductivity in the channel.

21. The display apparatus according to claim 20, wherein the second liquid is nonvolatile.

22. The liquid moving apparatus according to claim 16, wherein the plurality of wall surface electrodes are arranged along the channel; and the liquid is moved to one wall surface electrode or wall surface electrodes continuously arranged, among the plurality of wall surface electrodes, when the predetermined voltage is applied to the surface electrode or the wall surface electrodes continuously arranged.

* * * * *